US011591134B2

(12) United States Patent
Marschall

(10) Patent No.: US 11,591,134 B2
(45) Date of Patent: Feb. 28, 2023

(54) METHOD AND APPARATUS FOR INTERCONNECTABLE BUILDING BLOCK CONTAINER TOYS CAPABLE OF STORING ITEMS

(71) Applicant: Changebox IP Holdings, LLC, New Hope, PA (US)

(72) Inventor: Christopher Mark Marschall, New Hope, PA (US)

(73) Assignee: ChangeBox IP Holdings, LLC, New Hope, PA (US)

( * ) Notice: Subject to any disclaimer, the term of this patent is extended or adjusted under 35 U.S.C. 154(b) by 0 days.

(21) Appl. No.: 16/846,538

(22) Filed: Apr. 13, 2020

(65) Prior Publication Data

US 2020/0331659 A1 Oct. 22, 2020

Related U.S. Application Data

(63) Continuation of application No. 15/627,999, filed on Jun. 20, 2017, now Pat. No. 10,618,691, which is a (Continued)

(51) Int. Cl.
*B65D 21/024* (2006.01)
*B65D 21/02* (2006.01)
(Continued)

(52) U.S. Cl.
CPC ..... *B65D 21/0215* (2013.01); *A63H 33/003* (2013.01); *A63H 33/086* (2013.01);
(Continued)

(58) Field of Classification Search
CPC ..... B65D 21/0215; B65D 21/0204; B65D 21/02; B65D 21/0201; B65D 21/0224;
(Continued)

(56) References Cited

U.S. PATENT DOCUMENTS 1,459,309 A 6/1923 Miller
1,465,637 A 8/1923 Goss
(Continued)

FOREIGN PATENT DOCUMENTS

WO 9308888 A1 5/1993
WO 9831607 A1 7/1998
(Continued)

OTHER PUBLICATIONS

International Search Report and Written Opinion for PCT Application No. PCT/US2014/029904, prepared by the European Patent Office, dated Jun. 16, 2014, 9 pp.

*Primary Examiner* — Stephen J Castellano
(74) *Attorney, Agent, or Firm* — Rita C. Chipperson, Esq.; Chipperson Law Group, P.C.

(57) ABSTRACT

Methods and apparatus for removably or irremovably interconnectable building block containers such as those capable of initially storing consumable items such as food and drink. After consumption of the food or drink, the cavity containing same may be cleaned and/or refilled with consumable or non-consumable items. The building block containers are utilized as building block toys and may be manufactured or otherwise designed to be collectable. In one aspect, the container connectors are nearly identical such that any one connector may mate with any other connector. In another aspect, the connectors are nearly identical but the orientations of each connector vary to allow mating to occur when the connectors are properly oriented. In another aspect, the container is a cube juice box with connectors on all four corners of all six sides of the container. A frame for holding a juice container may also be utilized.

19 Claims, 19 Drawing Sheets

Related U.S. Application Data continuation-in-part of application No. 14/214,426, filed on Mar. 14, 2014, now abandoned.

(60) Provisional application No. 61/802,691, filed on Mar. 17, 2013.

(51) Int. Cl.

| | |
|---|---|
| ***B65D 85/72*** | (2006.01) |
| ***B65D 25/20*** | (2006.01) |
| ***A63H 33/00*** | (2006.01) |
| ***A63H 33/08*** | (2006.01) |
| ***B65D 81/36*** | (2006.01) |
| ***B65D 61/00*** | (2006.01) |
| ***B65D 77/28*** | (2006.01) |
| ***B65D 1/22*** | (2006.01) |
| ***B65D 77/30*** | (2006.01) |

(52) U.S. Cl.

CPC ..... *B65D 1/225* (2013.01); *B65D 21/02* (2013.01); *B65D 21/0201* (2013.01); *B65D 21/0204* (2013.01); *B65D 21/0224* (2013.01); *B65D 25/205* (2013.01); *B65D 61/00* (2013.01); *B65D 77/28* (2013.01); *B65D 77/30* (2013.01); *B65D 81/361* (2013.01); *B65D 85/72* (2013.01); *B65D 2231/022* (2013.01)

(58) Field of Classification Search

CPC .. B65D 77/30; B65D 85/72; B65D 2231/022; B65D 25/02; B65D 25/205

USPC ..... 220/737, 738

See application file for complete search history.

(56) References Cited

U.S. PATENT DOCUMENTS

| | | | | |
|---|---|---|---|---|
| 1,607,711 | A | 11/1926 | Walker | |
| 1,895,611 | A | 1/1933 | Doak | |
| D141,340 | S | 5/1945 | Greenfield | |
| 2,440,205 | A | 4/1948 | Mclain | |
| 3,138,398 | A | 6/1964 | Silverman | |
| 3,194,426 | A | 7/1965 | Brown | |
| 3,391,824 | A | 7/1968 | Wiseman | |
| 3,703,045 | A | 11/1972 | Nyman | |
| 3,966,075 | A | 6/1976 | Schultz | |
| 4,003,144 | A * | 1/1977 | Maddestra | A63F 9/0098 446/122 |
| D249,230 | S | 9/1978 | Van Der Veken | |
| D249,231 | S | 9/1978 | Van Der Veken | |
| D252,909 | S | 9/1979 | Bayly | |
| D252,910 | S | 9/1979 | Bayly | |
| 4,358,025 | A | 11/1982 | Urion | |
| 4,624,383 | A | 11/1986 | Moore | |
| 4,722,473 | A | 2/1988 | Sandrini et al. | |
| D301,260 | S * | 5/1989 | McLaughlin | D21/500 |
| 4,860,896 | A * | 8/1989 | Snider | A63H 33/04 206/427 |
| 4,919,296 | A * | 4/1990 | Kirsh | B65D 21/0204 220/23.4 |
| 5,180,088 | A * | 1/1993 | de Angeli | B60N 3/102 220/703 |
| 5,310,071 | A | 5/1994 | Rivlin et al. | |
| D369,100 | S | 4/1996 | Johnson | |
| 5,503,296 | A | 4/1996 | DiBaggio | |
| D371,281 | S | 7/1996 | Credle, Jr. | |
| D377,887 | S | 2/1997 | Credle, Jr. | |
| D391,999 | S | 3/1998 | Chininis | |
| 5,782,358 | A | 7/1998 | Walker | |
| D412,646 | S | 8/1999 | Credle, Jr. | |
| D412,662 | S | 8/1999 | Giskeodegaard et al. | |
| D421,335 | S | 3/2000 | Linard | |
| D437,366 | S | 2/2001 | Stemmler | |
| 6,256,914 | B1 | 7/2001 | Yeh | |
| D446,826 | S | 8/2001 | Dunn et al. | |
| 6,506,091 | B1 | 1/2003 | Garpow | |
| D481,767 | S | 11/2003 | May et al. | |
| D509,858 | S | 9/2005 | May et al. | |
| D515,940 | S | 2/2006 | Kratko | |
| 7,175,498 | B2 | 2/2007 | Garpow et al. | |
| D565,527 | S | 4/2008 | Riggs | |
| D610,212 | S | 2/2010 | Pedersen | |
| D616,044 | S | 5/2010 | Tervo | |
| D616,045 | S | 5/2010 | Tervo | |
| 8,393,485 | B2 * | 3/2013 | Gold | B65D 21/0204 220/23.4 |
| D695,350 | S | 12/2013 | Doleshal | |
| D698,869 | S | 2/2014 | Strzelewicz et al. | |
| D722,658 | S | 2/2015 | Marschall et al. | |
| 10,618,691 | B2 * | 4/2020 | Marschall | A63H 33/003 |
| 2002/0070218 | A1 | 6/2002 | Mozes | |
| 2005/0218159 | A1 * | 10/2005 | Hoour | B65D 25/205 222/321.7 |
| 2006/0243627 | A1 * | 11/2006 | Meissen | B65D 21/0204 206/509 |
| 2007/0039974 | A1 | 2/2007 | Lloyd | |
| 2007/0080089 | A1 | 4/2007 | Anschutz | |
| 2008/0217340 | A1 | 9/2008 | Jager | |
| 2010/0170897 | A1 | 7/2010 | Gold et al. | |
| 2011/0089070 | A1 | 4/2011 | Resnick | |
| 2014/0263299 | A1 | 9/2014 | Marschall et al. | |
| 2018/0072455 | A1 * | 3/2018 | Wilcox | B65D 21/0201 |

FOREIGN PATENT DOCUMENTS

| | | | |
|---|---|---|---|
| WO | 2013035079 | A1 | 3/2013 |
| WO | 20140153268 | A1 | 9/2014 |

* cited by examiner

METHOD AND APPARATUS FOR INTERCONNECTABLE BUILDING BLOCK CONTAINER TOYS CAPABLE OF STORING ITEMS

CROSS-REFERENCE TO RELATED APPLICATIONS

This application claims the benefit of and is a continuation of the U.S. patent application Ser. No. 15/627,999, filed Jun. 20, 2017, entitled "Method and Apparatus for interconnectable Building Block Container Toys Capable of Storing Items", now U.S. Pat. No. 10,618,691, which claims the benefit of and is a continuation-in-part of the U.S. patent application Ser. No. 14/214,426, filed Mar. 14, 2014, entitled "Method and Apparatus for interconnectable Building Block Containers Capable of Storing Items", which are both incorporated by reference in their entirety as if fully set forth herein, and which all claim the benefit of the U.S. provisional patent application Ser. No. 61/802,691, filed Mar. 17, 2013, entitled "Method and Apparatus for interconnectable Building Block Containers Capable of Storing Items", which is incorporated by reference in its entirety as if fully set forth herein.

BACKGROUND OF THE INVENTION

Embodiments of the present invention generally relate to interconnectable building block containers. More specifically, the present invention relates to interconnectable building block containers capable of initially storing consumable items such as food and subsequently storing consumable or non-consumable items.

Inter-lockable food containers designed for use as building block toys are known. Some such containers include a side of a first container having a male pin which can form a dovetail joint with a side of a second container having a female tail. Some such containers have bottoms that include a shallow square mortise hole which can loosely form a joint with a stubby square tenon on the top of another container.

Also known is a container with a threaded male cap designed for dispensing a liquid and for use as a building block toy wherein the male cap of a first container wall can be inserted into a central female receptacle of another container wall.

Additionally, containers are known designed with a cap and for use as a building block toy wherein a male tongue and a female groove located along the entire length of each side wall of a first container can be interlocked to a female groove and male tongue located along the entire length of each side wall of another container.

Also known is a LEGO® container designed to hold candy and for use as a building block toy wherein a male connector of a first LEGO® container block may be press-fitted into an open square female cavity on an opposite side of another LEGO® container block.

Finally, also known in the art are LEGO® flat snap-cap containers designed to hold liquid and for use as building block toys wherein a male connector of a first LEGO® container block may be press-fitted into an open square female cavity on an opposite side of a second LEGO® container block wherein the bottom side of the first LEGO® block has a central recess for the container cap of another LEGO® container block.

As illustrated above, methods and apparatus are known for reversibly interconnecting a plurality of food containers as building block toys wherein the reversible interconnection requires an integral male connector and an integral female connector wherein the integral male connector of a first food container is connected to the integral female connector of a second food container.

BRIEF SUMMARY OF THE INVENTION

Briefly stated, in one aspect of the invention, a container capable of initially storing a consumable item and subsequently storing a consumable or non-consumable item is provided. This container includes: a plurality of side walls; a bottom wall coupled to the plurality of side walls; a cavity between the inwardly facing surfaces of the plurality of side walls and the bottom wall, the consumable item or the non-consumable item located in the cavity; a top wall coupled to the plurality of side walls, the top wall including a cavity aperture; a seal covering the cavity aperture; a cover covering the seal; at least one connector located on each of the outwardly facing surfaces of the plurality of side walls, the bottom wall, and the top wall.

BRIEF DESCRIPTION OF THE SEVERAL VIEWS OF THE DRAWINGS

The foregoing summary, as well as the following detailed description of preferred embodiments of the invention, can be better understood when read in conjunction with the appended figures. For the purpose of illustrating the invention, there is shown in some of the figures, embodiments which are presently preferred. It should be understood, however, that the invention is not limited to the precise arrangements and instrumentalities shown depicted.

DETAILED DESCRIPTION OF THE INVENTION

Figure 1:
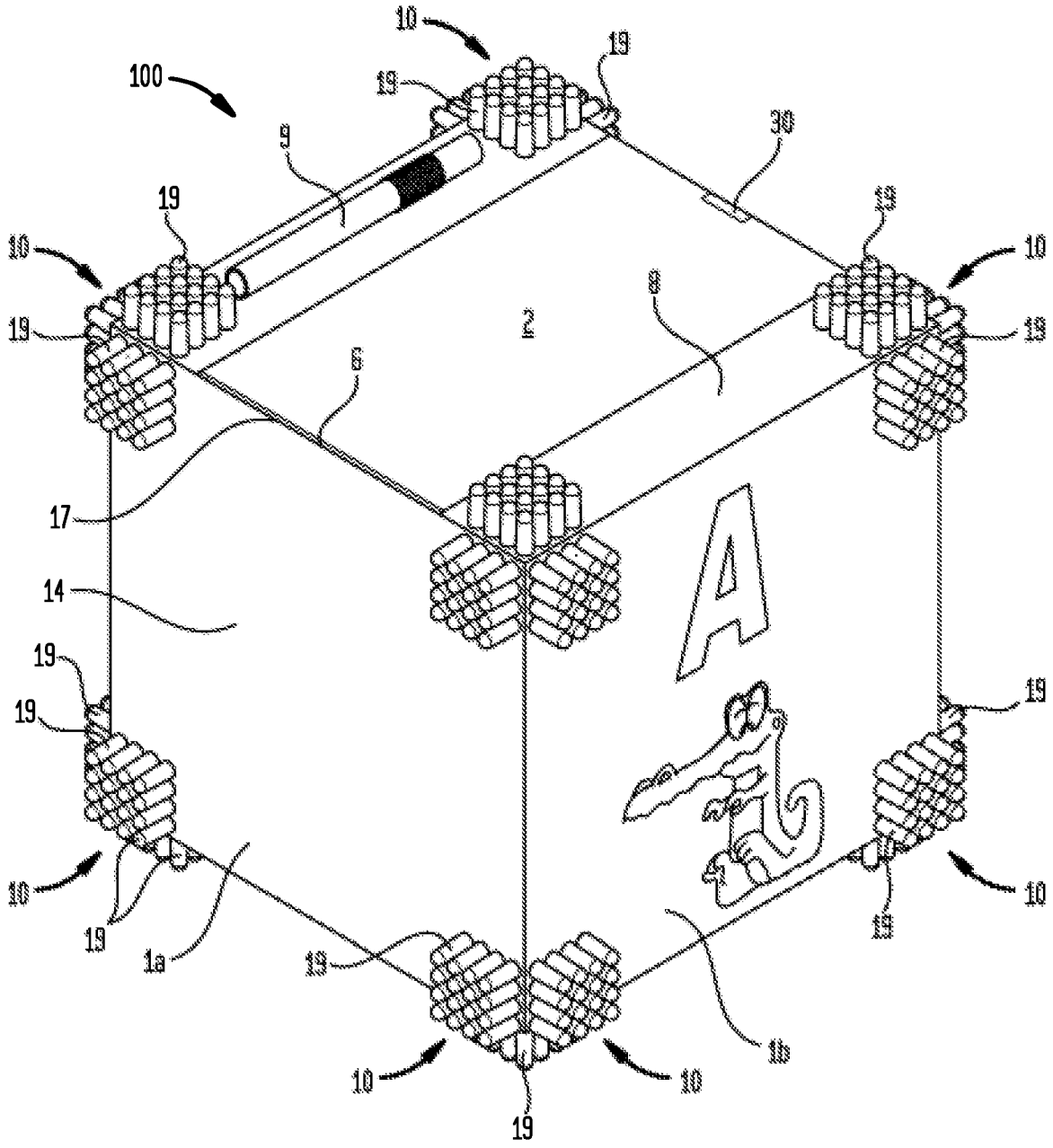
FIG. 1 is a perspective view of an exemplary interconnectable container in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a wall" may include a plurality of walls. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Referring first to FIG. 1, depicted is a perspective view of an exemplary interconnectable container 100. In the depicted embodiment, container 100 may contain a consumable product including, without limitation, a liquid, a semi-liquid, and a solid food. In the depicted exemplary embodiment, container 100 is shaped as a cube having six walls, however, other shapes and wall quantities may be substituted without departing from the scope of the present invention. That is, the exemplary embodiment depicted in FIGS. 1-4 is not intended to limit the scope of any characteristic of a container of the present invention with respect to its particular shape, size, dimension, wall thickness or any other characteristic, instrumentality, or method of use.

Figure 2A:
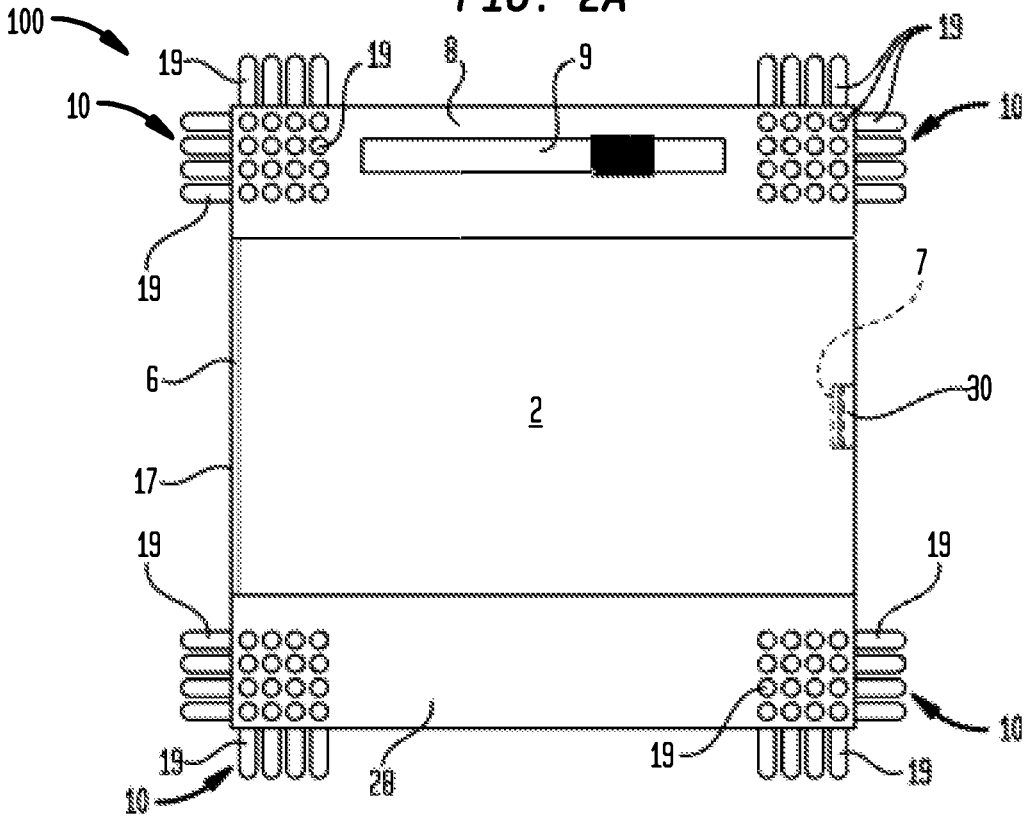
FIG. 2A depicts a top view of the container of FIG. 1 with a closed cover and intact seal in accordance with one embodiment of the present invention.
Figure 2B:
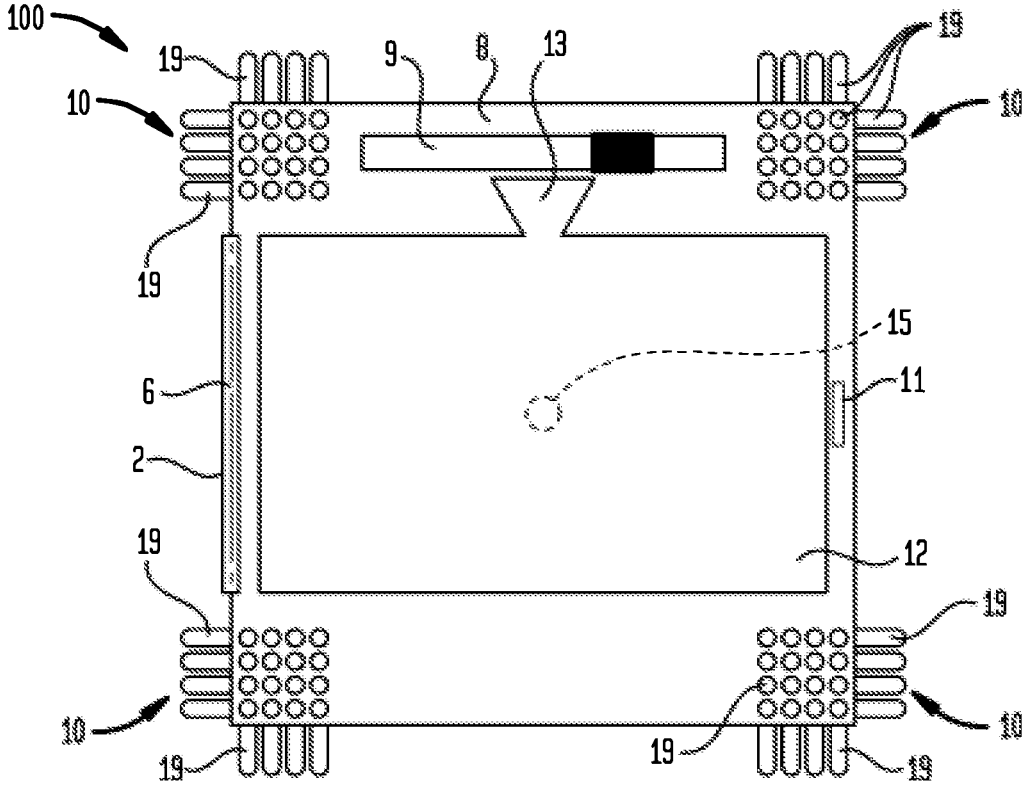
FIG. 2B depicts a top view of the container of FIG. 1 with an open cover and intact seal in accordance with one embodiment of the present invention.
Figure 2C:
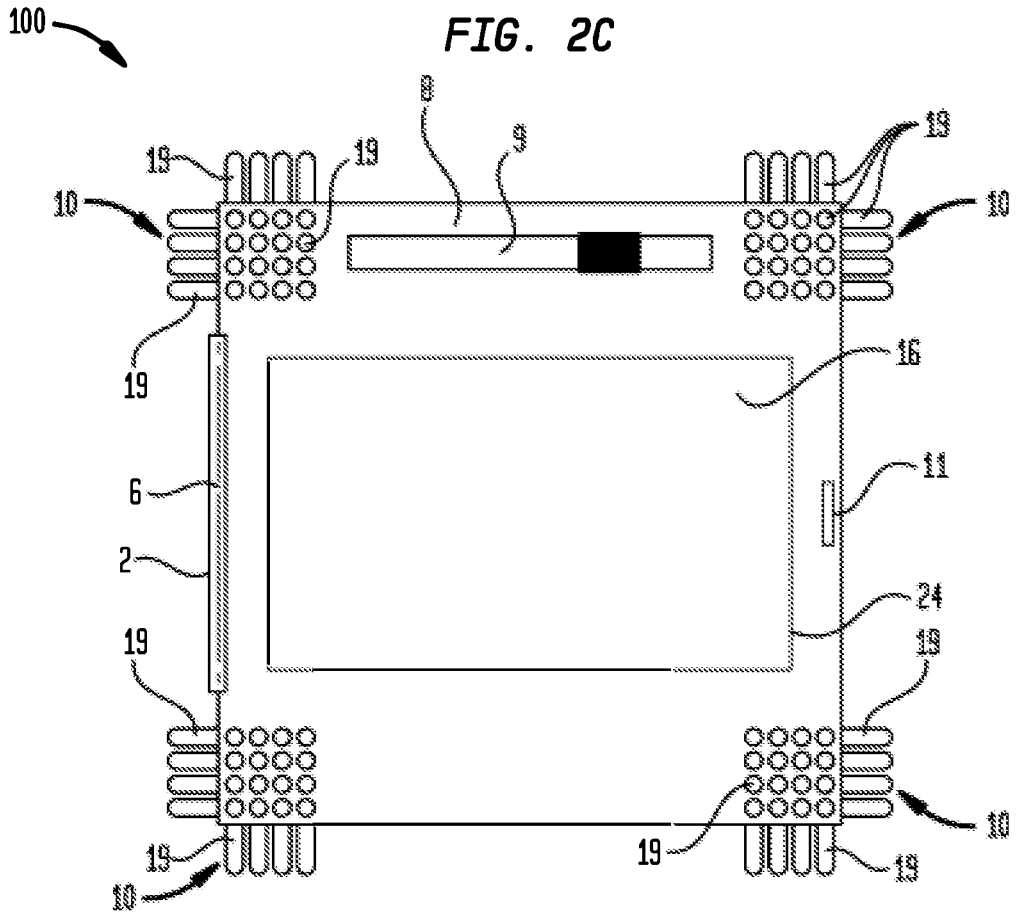
FIG. 2C depicts a top view of the container of FIG. 1 with an open cover and removed seal in accordance with one embodiment of the present invention.
Figure 2D:
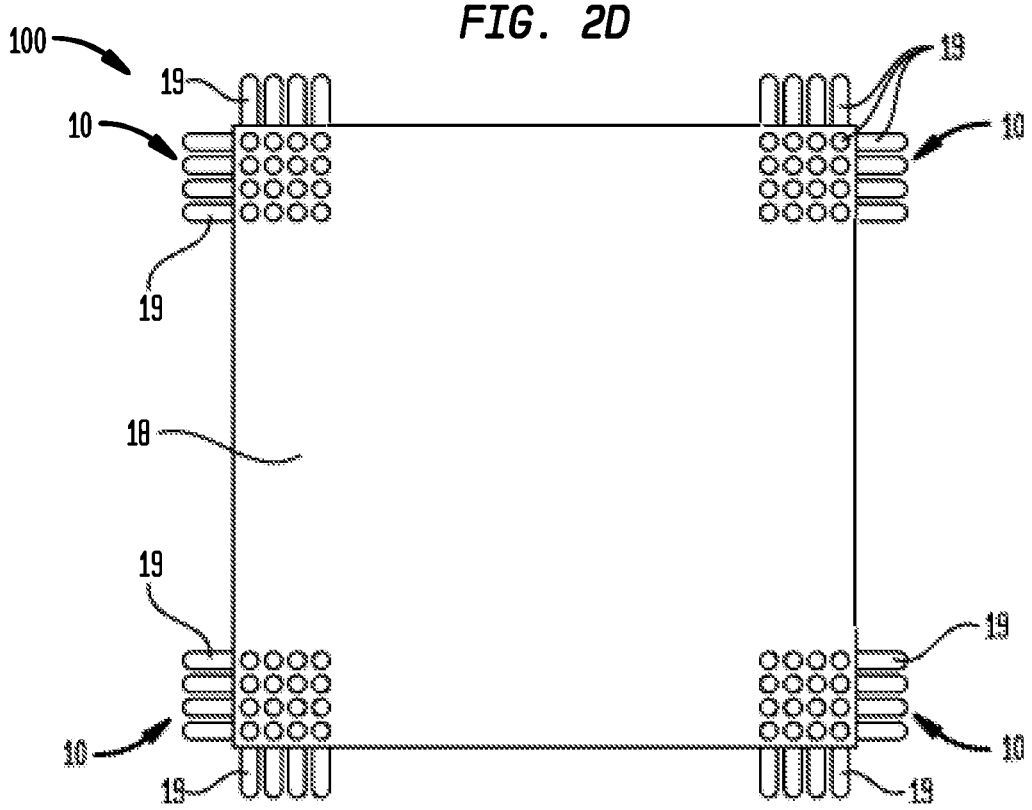
FIG. 2D depicts a bottom view of the container of FIG. 1 in accordance with one embodiment of the present invention.

More specifically, container 100, as depicted in FIG. 1, includes four identical side walls 1 (1*a* and 1*b* are shown), top wall 8, and a bottom wall 18 (See FIG. 2D). In the depicted embodiment, all of the aforementioned walls are moisture impermeable to allow container 100 to store or house a liquid or semi-liquid consumable product. However, alternate embodiments are envisioned in which such walls are not moisture-impermeable. In some such embodiments, a liner or the like located internal to container 100 may be utilized to allow container 100 to store or house a liquid or semi-liquid consumable product. Materials for side walls 1, top wall 8, and bottom wall 18 may include, but are not limited to, one or more of the following materials: paper, cardboard, plastic including, without limitation, BPA-free and recycled plastic material, metal (e.g., aluminum foil), wax coated plant fiber, ceramic, and glass. In the depicted embodiment, side walls 1, top wall 8, and a bottom wall 18 have a thickness of approximately one to two millimeters; however, other thicknesses may be substituted.

Side walls 1 and bottom wall 18 are substantially square and each include (4) identical connectors 10 that protrude from each corner thereof. Top wall 8 is also substantially square and includes four (4) identical connectors 10 protruding from each corner. Although side walls 1, top wall 8, and bottom wall 18 are each shown with (4) connectors, alternate connector quantities may be substituted without departing from the scope hereof. Further, alternate embodiments are envisioned in which one or more of the aforementioned walls have a different quantity of connectors than the remaining walls.

As best seen in FIGS. 2A through 2D, top wall 8 is identical to side walls 1 and bottom wall 18 with the exception that it includes cavity aperture 24, cover 2, fastener receptacle 11, and seal 12. Substantially rectangular cavity aperture 24 allows a user to remove the contents of cavity 16 and/or clean cavity 16. In the depicted embodiment, this may be done when cover 2 is open and seal 12 has been removed as discussed in greater detail below.

As best seen in FIG. 2A, cover 2 is connected to top wall edge 17 via cover connector 6. FIG. 2A depicts a top view of container 100 in which cover 2 is fully closed and its upwardly facing surface 2 is slightly raised relative to with upwardly facing surface 28 of top wall 8. However, alternate embodiments are envisioned in which upwardly facing surface 2 is substantially flush with upwardly facing surface 28 of top wall 8. Top cover 2 may protect seal 12 and/or cavity 16 when the container is not in use. Alternatively or additionally, top cover 2 allows top wall 8 of a used container to be fully closed to allow container 100 to function as a substantially cubic building block. Also, the re-closure ability of cover 2 allows a child to store items within cavity 16 (possibly after cavity 16 has been cleaned of any initial consumable item). However, embodiments of the present invention are envisioned in which cover 2 is omitted. In one such embodiment, the entire top wall 8 is removable and functions as a cover, thereby omitting the need for an independent cover 2. In one such alternate embodiment, there is no cover (e.g., removable seal 12 or the like may be utilized to retain the consumable item in cavity 16 prior to consumption). Further, although cover 2 depicted in FIGS. 1-4 does not include a connector 10, covers including connectors are also envisioned.

In the exemplary embodiment depicted in FIGS. 1-4, cover connector 6 is a hinge, however, any other connectors that allow cover 2 to open and close may be substituted without departing from the scope hereof. Cover connector 6, when in the form of a hinge, allows top cover 2 to pivot between a fully open position (in which it is located adjacent and substantially flush against side wall 1*a* to allow cavity 16 to be more easily emptied, filled, and/or cleaned) or a fully closed position in which cover 2 is slightly raised relative to upwardly facing surface 28 of top wall 8 and fastener 7 is mated with fastener receptacle 11 as discussed below.

In the depicted embodiment, cover 2 includes a fastener 7 for retaining cover 2 in a fully closed or nearly fully closed position. Fastener 7 may be any type of protrusion or the like capable of mating with fastener receptacle 11, the latter of which is recessed in top wall 8. That is, fastener 7 may be pushed into fastener receptacle 11, after which it is held therein via the pressure exerted on fastener 7 by the interior walls of fastener receptacle 11 until pressure is applied in an opposite, unlocking direction to remove fastener 7 from fastener receptacle 11 (e.g., pressure may be applied via a fingernail or the like). In one embodiment, groove 30 (FIG. 1) is provided at the distal end of cover 2 to facilitate application of pressure in an unlocking direction. Groove 30 is any indent or other mechanism located on the side and/or top of cover 2 capable of insertion of a fingernail or the like to facilitate application of an upward pressure upon cover 2. Although a snapping type fastener is utilized in the depicted embodiment, other fasteners may be substituted without departing from the scope hereof. It should also be noted that in alternate embodiments, the portion of top wall 8 upon which cover 2 rests may be vertically recessed to allow the upwardly facing surface of cover 2 to be substantially flush with upwardly facing surface 28 of top wall 8 when cover 2 is in a closed position.

Referring now to FIG. 2B, container 100 is depicted with a fully open cover 2 and intact seal 12. In FIG. 2B, cover 2 has been disconnected from top wall 8 via release of fastener 7 from fastener receptacle 11 and has been rotated or otherwise repositioned such that the upwardly facing surface of cover 2 (FIG. 2A) abuts the outwardly facing surface 14 of side wall 1*a* (FIG. 1).

FIG. 2B also depicts removable seal 12 in an intact position. In this position, seal 12 may maintain the freshness of the consumable product within container 100 and/or assist in containing the consumable product within container 100. In some embodiments, seal 12 operates as a moisture-impermeable barrier to contain a liquid or semi-liquid consumable product within container 100 and/or cavity 16. In the depicted embodiment, seal 12 is a thin metal foil, however, other types of seals may be substituted without departing from the scope hereof including, without limitation, cardboard, plastic, non-foil metal, and waxed-paper seals.

Further, in the depicted embodiment, seal 12 is secured to the upwardly facing surface of the portions of top wall 8 that surround seal aperture 24 via an adhesive or the like applied to the downwardly facing edges of seal 12 prior to placement of seal 12 atop top wall 8. However, other methods of securing seal 12 to container 100 may be substituted including, without limitation, seals that insert into cavity 16 and are retained therein via the pressure exerted on seal 12 by the interior walls of cavity 16. In one embodiment of the present invention, seal 12 also functions to retain a straw or the like in an upright position during consumption of a consumable liquid by the user. In such embodiments, seal 12 may include puncture indicia 15 (e.g., a dashed line) to indicate a preferred location for puncturing seal 12. In one embodiment, this preferred location may be thinner than the surrounding portion of seal 12; however, this is not required to implement the present invention. Furthermore, puncture indicia 15 is not necessary to implement the present invention as seal 12 may be formed to allow puncturing via a straw or the like in any desired location. In embodiments incorporating a straw, a straw such as straw 9 may be pre-packaged with a container by affixing it to any external surface of container 100 via a removable adhesive or the like. That is, once the straw is removed for use, the means for holding the straw to the container 100 may be completely removed via soap and water or other easy method of cleaning.

Optionally, all or a portion of the straw may be compressed to allow it to more easily fit upon container 100. In some embodiments, seal 12 includes tab 13 to facilitate removal of seal 12. In one form, tab 13 is made of the same material as seal 12 and it extends therefrom. During manufacturing, tab 13 may be folded atop seal 12 and under cover 2 prior to the closing of cover 2 to prevent tab 13 from being visible prior to use of container 100. That is, when cover 2 is opened for the first time, tab 13 will unfold to the position shown in FIG. 2B. The user may then easily grasp tab 13, which when pulled, may easily remove seal 12 in its entirety. When container 100 houses a semi-liquid or solid consumable product, a user may wish to completely remove seal 12 prior to consuming the product to more easily access the food therein with a food utensil. Conversely, when the consumable product is a liquid, the user may wish to wait to remove seal 12 until after the product has been consumed to avoid spillage or the like. In either scenario, removal of seal 12 facilitates cleaning of container 100.

Referring next to FIG. 2C, container 100 is depicted with a fully open cover 2 and seal 12 removed in accordance with one embodiment of the present invention. As discussed above, full opening of top cover 2 and removal of seal 12 facilitate consumption of semi-solid or solid foods, cleaning of cavity 16, and or re-filling cavity 16 with a consumable or non-consumable item. As seen in FIG. 2C, cavity 16 is the area located within top wall 8, side walls 1, and bottom wall 18. In some embodiments of the present invention, the capacity of container 100 and/or cavity 16 is such that container 100 stores approximately 6.75 fluid ounces, however, other sizes may be substituted without departing from the scope hereof.

Any one or more of side walls 1, top wall 8, and a bottom wall 18 may include ornamental, educational, or other indicia 26 to increase the aesthetic appeal of container 100. Such indicia may include, but is not limited to, animals, numbers and letters, pictures, trademarks, characters, copyrighted materials, and descriptive information regarding the contents of the container. Further, any one or more of such walls may be colored. Or such walls may be decorated to promote health and nutrition. The coloring and indicia of the walls may vary from container to container to allow a user of a plurality of containers 100 to collect specific ones of containers 100. Containers 100 may also include wrap-around labels or the like, optionally with branding, product, nutritional, and/or ingredient information. Indicia 26 and/or product branding may be omitted from any one or more of side walls 1, top wall 8, and/or bottom wall 18 without departing from the scope hereof.

Figure 3A:
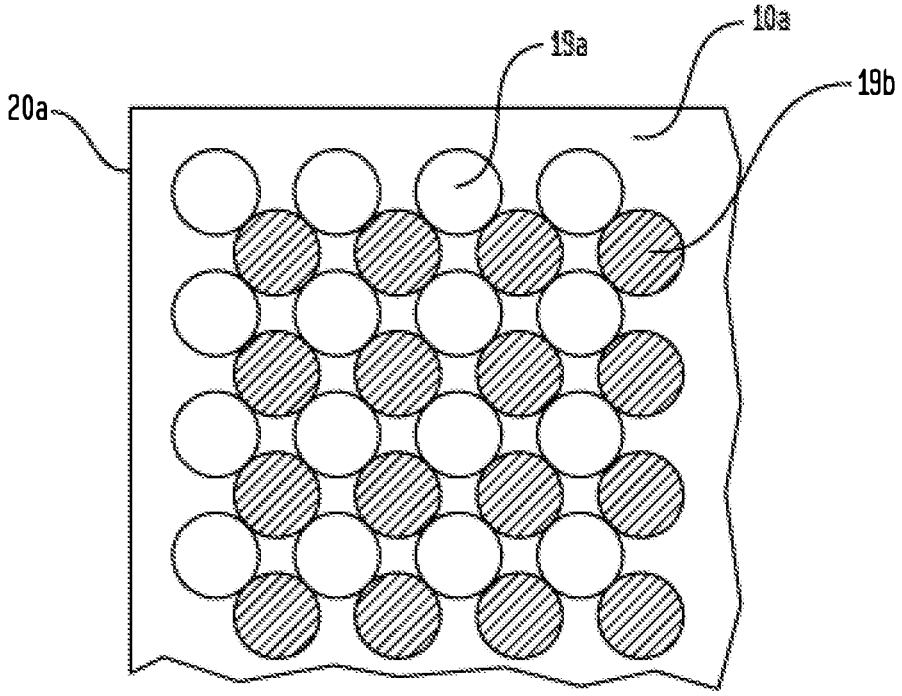
FIG. 3A is a cross-sectional view of the pair of connected connectors depicted in FIG. 3B taken along lines 3A-3A of FIG. 3B.
Figure 3B:
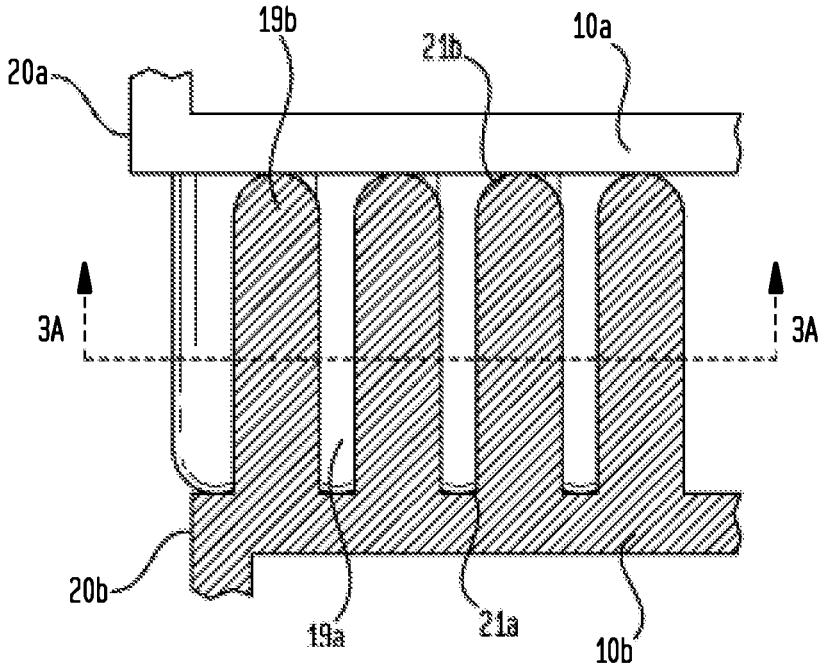
FIG. 3B is an enlarged side view of a pair of connected connectors in accordance with one embodiment of the present invention.

FIGS. 3A and 3B depict enlarged front and side views, respectively, of an exemplary connector 10*a* mated to an exemplary connector 10*b*. Both connectors 10*a* and 10*b* include a four by four array of bristles 19*a* and 19*b* extending from one an exemplary container outwardly facing surface 20*a* and 20*b*, respectively. However, varying bristle quantities may be substituted without departing from the scope hereof.

As also seen in FIG. 3A, bristles 19*a* are arranged in an alternating pattern in which the spacing between each bristle 19*a* is such that a mating bristle 19*b* may fit between a plurality of bristles 19*a*. That is, each of connectors 10 include bristles 19*a* arranged in a substantially identical pattern, which allows each connector 10 to mate with every other connector 10 such that the containers 100 may be interconnected, or "built" together, in any number of ways. In this manner, containers 110 function as toy blocks that may be arranged and interconnected as desired by the user without the need for the ability to match a female component to a male component.

FIG. 3B depicts a side view of two mated connectors 10, which details the resulting alternating pattern of bristles that results when two connectors 10 are mated. Each bristle 19*a* holds adjacent bristles 19*b* in an interlocked position via friction or pressure. It should be noted that connectors 10*a* and 10*b* are substantially identical, which allows containers 100 to be more easily connected with any one or more other containers 100. That is, a user of the containers is not limited to matching a male connector to a female connector since all connectors 10 are compatible with all other connectors 10 in the depicted embodiment of the present invention.

Also, although the depicted connectors 10 each include sixteen (16) bristles 19 arranged in an alternating pattern, alternate quantities and/or bristle patterns may be substituted without departing from the scope hereof. Similarly, although the bristles 19 of FIG. 3B are depicted as parallel, other embodiments of the invention are envisioned in which bristles 19 are not parallel. Further, the distribution of bristles 19 may occur in a random or organized manner. Also, bristle ends 21 may be rounded or pointed to facilitate sliding together, or interconnecting, of opposing bristles. Further, although FIGS. 3A and 3B depict a connector that includes substantially cylindrical bristles with rounded tips 19, connectors may be substituted having any one or more of the following characteristics: a greater or lesser quantity of bristles; longer or shorter bristles relative to the depicted base thickness; thicker or thinner bristles relative to the base thickness; bristles having varying degrees of flexibility; bristles having varying diameters; bristles having round, square, and/or polygonal shafts or a combination thereof a combination of parallel and non-parallel bristles; wedge-shaped bristles, varying base anchoring including individually anchored bristles as depicted in FIG. 3B, bristles anchored in bundles, and combinations thereof. In addition, some bristles may be coated with a friction-modifying substance.

Although the depicted embodiment includes nearly identical bristle-type connectors 10, varying types of identical or non-identical connectors may be substituted without departing from the scope hereof including, without limitation, Velcro® connectors, magnetic connectors, male and female mating connectors, pin and tail connectors, tongue and groove connectors, mortise and tenon connectors, and reversible adhesive connectors.

As best seen in FIGS. 2A-2D, in the exemplary embodiment depicted in FIGS. 1-4, each of connectors 10 are substantially flat and have relatively short bristles 19. In the depicted exemplary embodiment of the present invention, the length of bristles 19 is 5 millimeters; however, varying lengths may be substituted without departing from the scope of the present invention.

In the exemplary embodiment, connectors 10 are located at the corners of side walls 1, top wall 8, and bottom wall 18 to increase the durability of container 100. That is, the corner and edge surfaces of a hollow cube provide better support than the middle wall surfaces due to the support received from the interconnection of each of such surfaces with the adjacent sides of the cube. This positioning of connectors 10 reduces the potential flexion of the middle wall surfaces of side walls 1, top wall 8, and bottom wall 18, thereby minimizing the potential of wall deformation during interconnection of a plurality of containers 100 as discussed in greater detail with respect to FIG. 4 below. However, alternate connector locations may be substituted without departing from the scope of the present invention.

Figure 4:
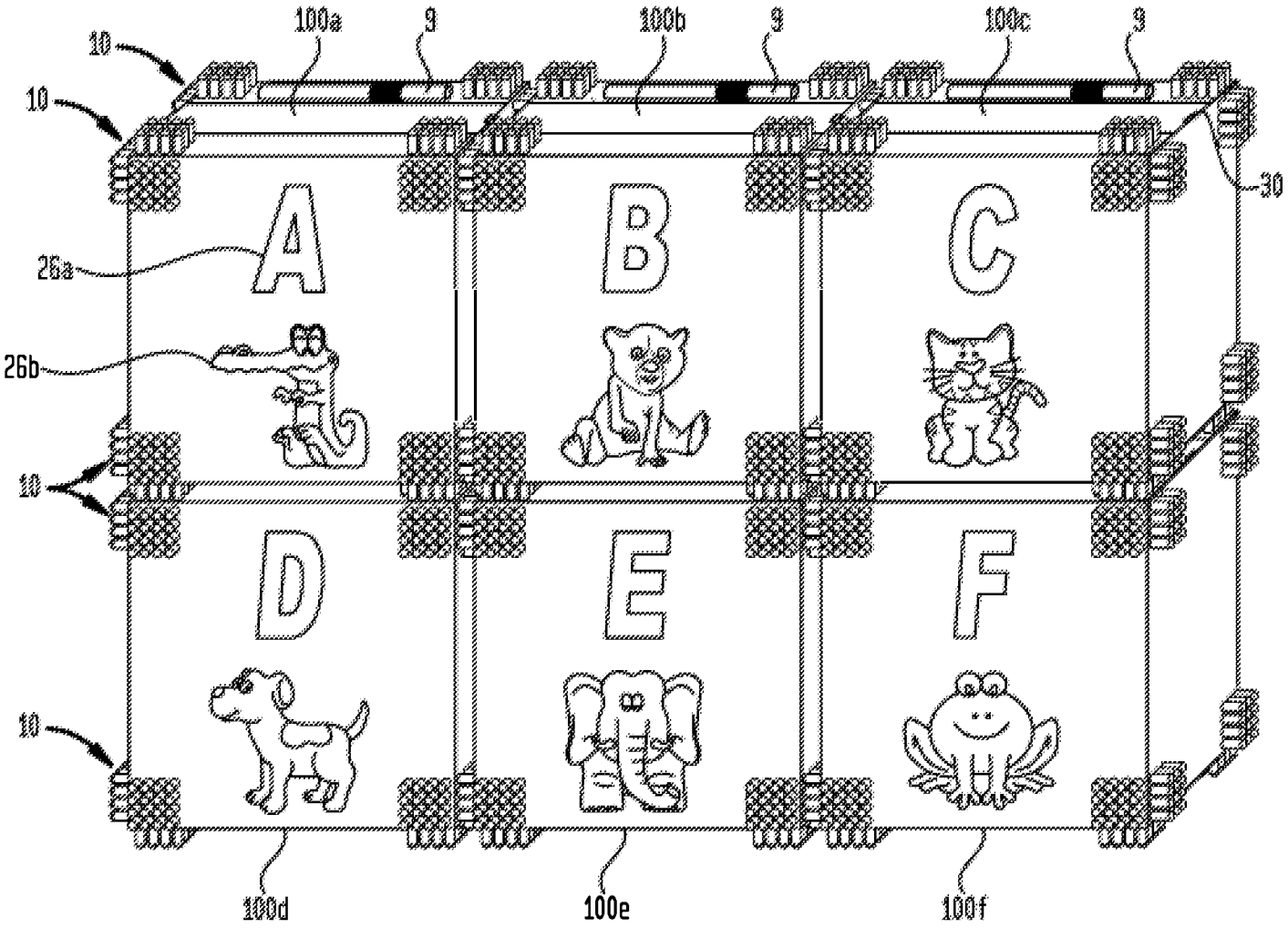
FIG. 4 is a perspective view of the interconnection of six of the containers depicted in FIG. 1 in accordance with one embodiment of the present invention.

Turning now to FIG. 4, depicted is a perspective view of an exemplary object which may be built by interconnecting six containers 100*a*-100*f*. With regards to FIG. 4, each of the connectors 10 have been mated such that a side of a first container mates squarely with the side of a second container. However, as discussed above, since all connectors of the depicted embodiment are nearly identical, many other objects can be created utilizing a plurality of containers 100. In one embodiment, it is envisioned that a plurality of containers 100 including letter indicia 26 or the like may be connected in a manner that allows the user to spell words or perform other educational activities.

In one embodiment of the present invention, containers 100 are juice boxes or other beverage boxes for use by children. In such an embodiment, containers 100 may be connected as shown in FIG. 4 (i.e., to form a substantially rectangular object) to facilitate packaging, packing, display, and shipment of the containers prior to sale to an end user.

Figure 5:
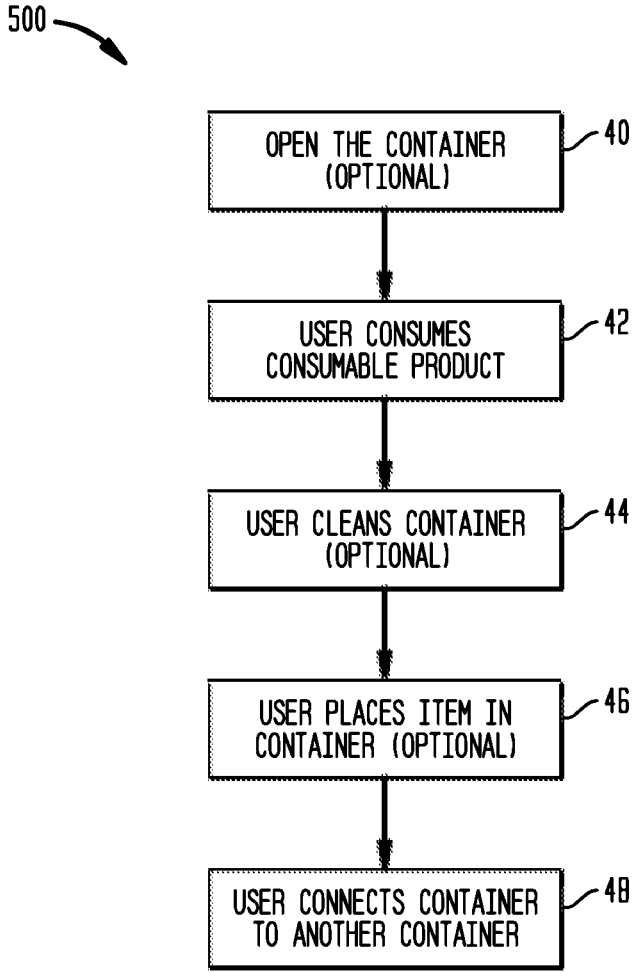
FIG. 5 is a flowchart of one method of using a container in accordance with one embodiment of the present invention.

Referring next to FIG. 5, depicted is a flowchart of one method 500 of practicing the present invention in accordance with one embodiment of the present invention. First, at 40, the user optionally opens the container. This step may not be required in some embodiments of the present invention in which the consumable product is accessible without opening of the container such as is the case with container system 600 as depicted in FIGS. 6 through 10D. That is, when utilizing a container system such as container system 600, the user skips step 40 and merely inserts a straw through access aperture 826 and top 704 as discussed in greater detail below with regards to FIG. 8B. Next, at 42, a user consumes the consumable product contained in at least one container. This step optionally includes removing the seal and/or opening the cover.

Thereafter, at 44, a user may clean the container; however, this is not required to implement the present invention. This cleaning step may also include removing the seal, opening the cover, and locking the cover in a closed position after cleaning is complete. If a user skips the cleaning step, the user may still lock the cover in place to create an intact building block with no partially open covers. However, embodiments of the invention are envisioned in which one or more sides of the container include one or more exposed cavities after the consumable item is consumed (i.e., cavities that are not encased with a movable cover).

Next, at 46, a user may optionally place one or more consumable or non-consumable items in the cavity for enjoyment or storage. This step may also include opening and/or resealing of the cover. Then, at 48, a user may removably or irremovably connect an empty or filled first container with one or more empty or filled second containers to create an object (i.e., the second filled container may be one initially filled with a consumable item or one that was filled by the user after removal of the consumable item and/or cleaning of the cavity).

After process 500 is complete, in embodiments of the present invention in which the connectors are removably connected, a user may change or disassemble the object and the user may re-use the containers to create one or more new objects.

Figure 6:
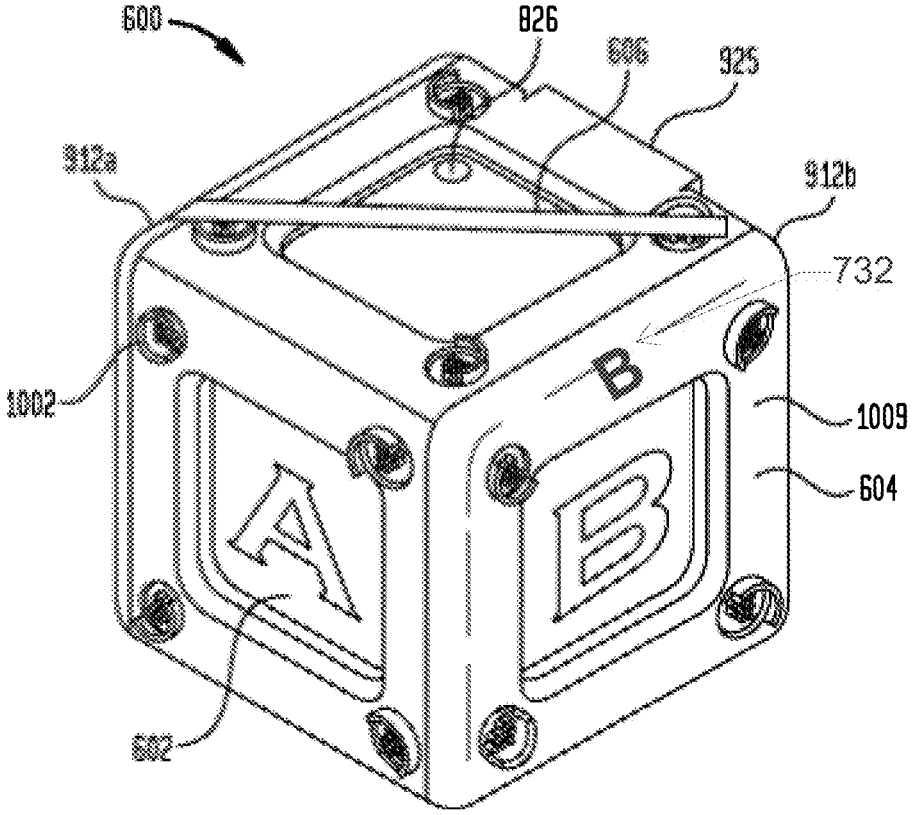
FIG. 6 is a perspective view of an exemplary interconnectable container system in accordance with one alternate embodiment of the present invention.

Turning next to FIG. 6, depicted is a perspective view of an exemplary interconnectable container system 600 in accordance with an alternate embodiment of the present invention. Similar to container 100, container system 600 may contain a consumable product including, without limitation, a liquid, a semi-liquid, and a solid food. In the depicted exemplary alternate embodiment, container system 600 includes a frame 604 that encloses a product container 602. In the depicted embodiment, product container 602 is not able to be removed from frame 604, however, alternate embodiments are envisioned in which container 602 may be removed from frame 604. Alternate embodiments are also envisioned in which container 602 is disposable, and new containers may be inserted in frame 604 or in an empty container 602 (the container 602 still contained in frame 604).

In some embodiments of the invention, container 602 contains a drinkable consumable product. However, alternate embodiments are envisioned in which container 602 includes an alternate product or no product at all. For the latter, if container 602 is empty, components thereof may be eliminated including, without limitation, top 704.

For embodiments including a drinkable consumable product, a straw such as straw 606 may be pre-packaged with container system 600 by affixing it to any external surface of container system 600 via a removable adhesive or the like. That is, once the straw is removed for use, the means for holding the straw to the container system 600 may be completely removed via soap and water or other easy method of cleaning.

Also, in the depicted embodiment, straw 606 is located between two opposing corners of container system 600 such as corners 912*a* and 912*b*. Such positioning allows the straw to be longer and affixed to the top of container system 600 without extending beyond the borders thereof. Optionally, all or a portion of the straw may be compressed to allow it to more easily fit upon container system 600 without extending beyond the borders thereof (or minimizing the extent to which the straw extends beyond the borders thereof). However, alternate embodiments are envisioned in which straw 606 extends beyond the borders of frame 604.

Figure 7A:
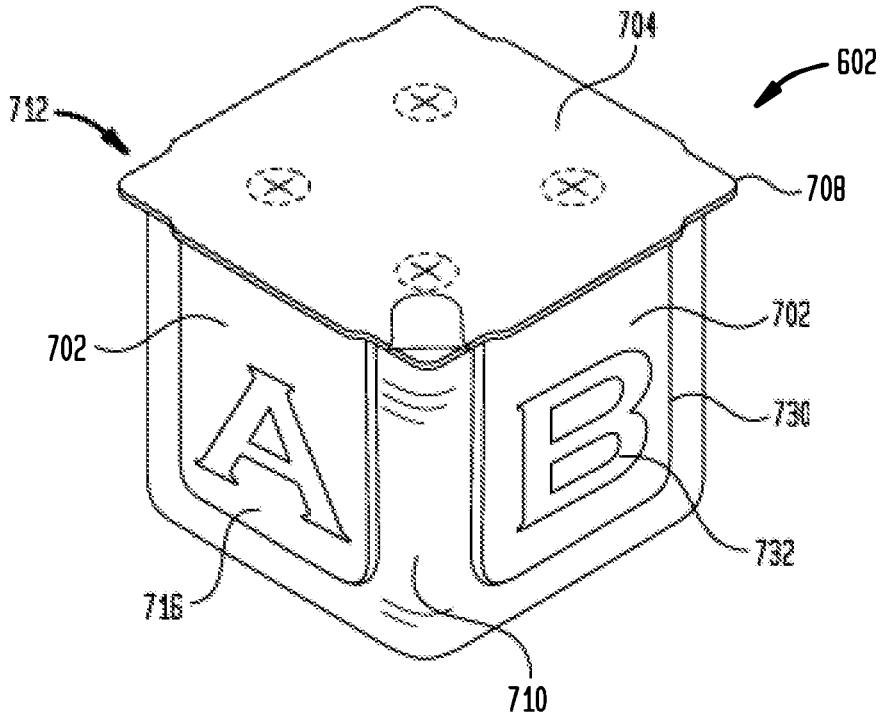
FIG. 7A depicts a perspective view of a container for use with the container system depicted in FIG. 6 in accordance with one alternate embodiment of the present invention.
Figure 7B:
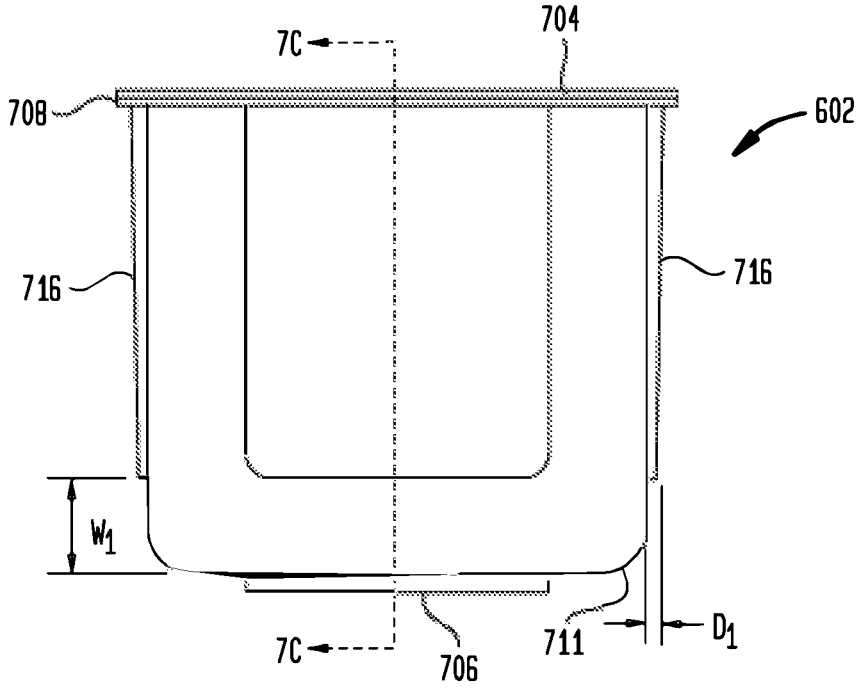
FIG. 7B depicts a side view of the container depicted in FIG. 7A in accordance with one alternate embodiment of the present invention.
Figure 7C:
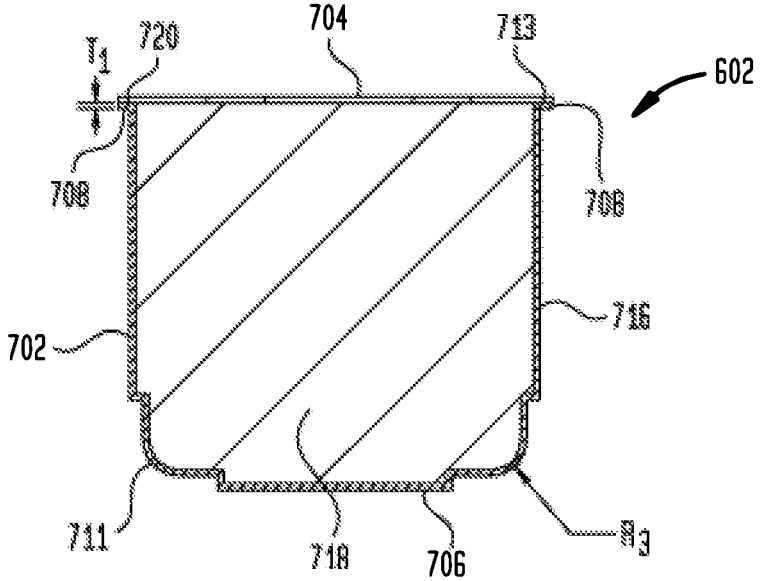
FIG. 7C depicts a cross-sectional view of the container depicted in FIGS. 7A and 7B taken along lines 7C-7C of FIG. 7B in accordance with one alternate embodiment of the present invention.
Figure 7D:
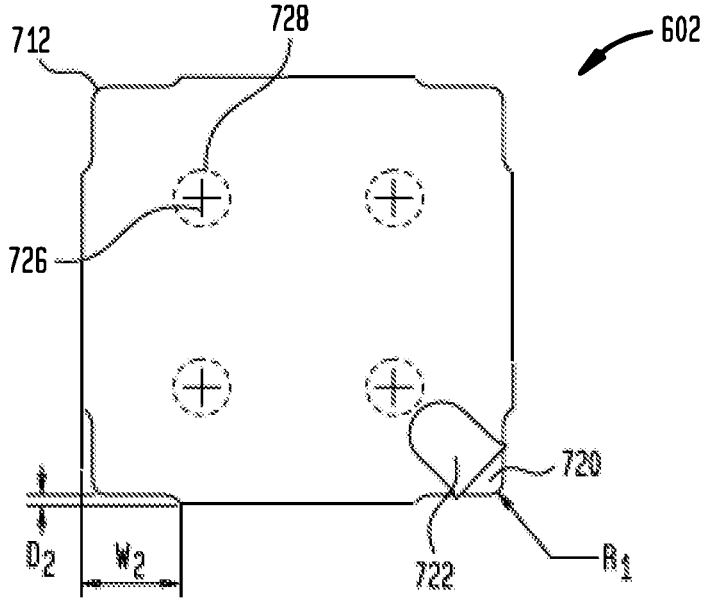
FIG. 7D depicts a top view of the container depicted in FIG. 7A through 7C in accordance with one alternate embodiment of the present invention.

Referring now to FIGS. 7A through 7D, depicted are perspective, side, cross-sectional, and top views of a container 602 for use with container system 600 of FIG. 6 in accordance with one embodiment of the present invention. The cross-sectional view of FIG. 7C is taken along lines 7C-7C of FIG. 7B.

Container 602 includes top 704, bottom 706, and four substantially identical sides 702, and it is substantially a cube with the exception of rounded side and bottom edges 710 and 711, respectively, and each of sides 702 is angled slightly inward such that the bottom portion of container 602 has a slightly smaller cross-section than the top portion thereof. Each of the sides 702 is approximately 2.342 inches square, bottom 706 is approximately 2.303 inches square, and flanged top 704 is approximately 2.59 inches square, with the exception of the indented and rounded corners 712 as discussed in greater detail below. However, other shapes and sizes may be substituted without departing from the scope hereof.

In the depicted embodiment, sides 702, top 704, and bottom 706 are moisture impermeable to allow container 602 to store or house a liquid or semi-liquid consumable product. However, alternate embodiments are envisioned in which such walls are not moisture-impermeable. Materials for sides 702 and bottom 706 may include, but are not limited to, one or more of the following materials: paper, cardboard, plastic including, without limitation, BPA-free and recycled plastic material, metal (e.g., aluminum foil), wax coated plant fiber, ceramic, and glass. In the depicted embodiment, both container 602 and frame 604 are made of polypropylene plastic to allow them to be easily recycled as a whole, however, alternate materials may be substituted. Further, container 602 and frame 604 may be made of different materials without departing from the scope hereof.

As best seen in FIG. 7A through FIG. 7C, each container side 702 is substantially square with the exception of flange 708 and rounded, indented container side and bottom edges 710 and 711, respectively. That is, the left and right edges 710 and bottom edge 711 of each container side 702 is rounded, and has a radius $R_3$ of approximately 0.175 inches. Edges 710 and 711 are also indented relative to the outermost faces 716 of sides 702. The width $W_1$ of the indented portion of each edge 710 is approximately 0.453 inches, and the depth $D_1$ of the indentation is approximately 0.06 inches relative to face 716. However, alternate radii, widths, and depths may be substituted without departing from the scope hereof. Or, corners may be formed without rounding and/or an indent without departing from the scope hereof.

As best seen in FIG. 7C, flange 708 extends outwardly from top ends 713 of sides 702 substantially perpendicular to sides 702. The thickness $T_1$ of flange 708 is approximately 0.04 inches which is substantially equivalent to the thickness of sides 702. The shape of the perimeter of flange 708 is substantially identical to the shape of the perimeter of top 704 as best seen in the top view of shape FIG. 7D. More specifically, the shape of the perimeter of flange 708 and top 704 is substantially square with the exception of indented and rounded corners 712. In the depicted embodiment, corners 712 have a radius $R_1$ of 0.085 inches, and the sides are indented to a width $W_2$ of approximately 0.595 inches. Additionally, the indentations are a distance $D_2$ of approximately 0.06 inches from the perimeter of sides 702. However, alternate radii, distances, and lengths may be substituted without departing from the scope hereof.

As best seen in the cross-sectional view of FIG. 7C, cavity 718 is the area located within top 704, sides 702, and bottom 706. In some embodiments of the present invention, the capacity of container 602 and/or cavity 718 is such that container 602 stores approximately six (6) fluid ounces, however, other sizes may be substituted without departing from the scope hereof.

Top 704 is also substantially square and has a perimeter that substantially matches the perimeter of flange 708 as discussed above. Removable top 704 is depicted in FIGS. 7A through 7D in an intact position. In this position, top 704 may maintain the freshness of the consumable product within container 602 and/or assist in containing the consumable product within container 602. In some embodiments, top 704 operates as a moisture-impermeable barrier to contain a liquid or semi-liquid consumable product within container 602 and/or cavity 718.

In the depicted embodiment, top 704 is a heat sealed foil laminate. That is, after cavity 718 is filled with a consumable (or non-consumable) product, top 704 is heat sealed to upwardly facing surface 720 of flange 708. However, other materials for top 704 may be substituted without departing from the scope hereof including, without limitation, thin metal seals other than foil laminate, cardboard, plastic, non-foil metal, and waxed-paper seals. Also, other methods of securing top 704 to container 602 may be substituted including, without limitation, application of an adhesive to the upwardly facing surface 720 of flange 708 prior to placement of top 704.

In one embodiment of the present invention, top 704 also functions to retain a straw or the like in an upright position during consumption of a consumable liquid by the user. In such embodiments, top 704 may include puncture indicia 726 and/or one or more perforated lines 728 to indicate a preferred location for puncturing top 704 with a straw or the like. In the depicted embodiment, perforated line 728 is in the form of a circle that surrounds puncture indicia 726, the latter of which is in the form of a plus sign. Additionally, each set of perforated lines 728 and indicia 726 are located at the same distance inward from each of the four corners 712. In some embodiments, puncture indicia 726 and/or one or more perforated lines 728 are located such that they will substantially align with access aperture 826, such that a straw passed through access aperture 826 shall also pierce the puncture indicia 726 and/or one or more perforated lines 728. However, other types, quantities, and locations of puncture indicia and/or perforated lines may be substituted without departing from the scope hereof. Also, puncture indicia and/or perforated lines are not required to implement the present invention.

In some embodiments of the present invention such as that depicted in FIGS. 6 through 10D, top 704 includes tab 722 to facilitate removal of top 704. In one form, tab 722 is made of the same material as top 704 and it is simply an extended piece thereof. During manufacturing, tab 722 may be folded rearward atop top 704 such that it lies thereupon as depicted in the perspective view of FIG. 7A and top view of FIG. 7D. After container 602 is inserted in frame 604 as described in greater detail below, frame top 904 acts as a cover that obscures tab 722 until frame top 904 is opened by the user. This prevents tab 722 from being visible prior to use of container system 600. That is, when frame top 904 is opened for the first time, tab 722 will first be visible to the user. The user may then easily grasp tab 722, which when pulled, may easily remove top 704 in its entirety. When container system 600 houses a semi-liquid or solid consumable product, a user may wish to completely remove top 704 prior to consuming the product to more easily access the food therein with a food utensil. Conversely, when the consumable product is a liquid, the user may wish to wait to remove top 704 until after the product has been consumed to avoid spillage or the like. In either scenario, removal of top 704 facilitates cleaning of container 100.

Any one or more of sides 702 and bottom 706 may include ornamental, educational, or other indicia 732 to increase the aesthetic appeal of the container system. Such indicia is described in greater detail above with regards to FIGS. 1 through 5. Further, any one or more of such walls may be colored, or such walls may be decorated to promote health and nutrition as also described above. The coloring and indicia of the walls may vary from container system to container system to allow a user of a plurality of container systems 600 to collect specific ones of the container systems 600.

In the depicted embodiment, the indicia 732 and/or other artwork is applied to container 602 in the form of an adhesive-backed label 730. In the depicted embodiment, label 730 is the full size of outermost face 716, but smaller labels may be substituted. In the depicted embodiment of the present invention, although label 730 does not extend throughout the entire surface of side 702, it extends throughout the visible portion of such sides. That is, once container 602 is inserted into frame 604 as discussed in greater detail below, the portions of container 602 that are not covered by label 730 are obscured by frame 604 and are therefore not visible to the user of container system 600. In the depicted embodiment, frame 604 also obscures the edges of label 730 thereby giving the appearance that the indicia is part of container 602 rather than a label or the like attached thereto. Such label or the like may be permanent or removable, without departing from the scope hereof. However, indicia 732 and/or labels 730 may also be omitted from one or more of sides 702 and/or bottom 706 without departing from the scope hereof. Also, indicia may be included in other forms including, without limitation, direct printing of the indicia on container 602.

Figure 9A:
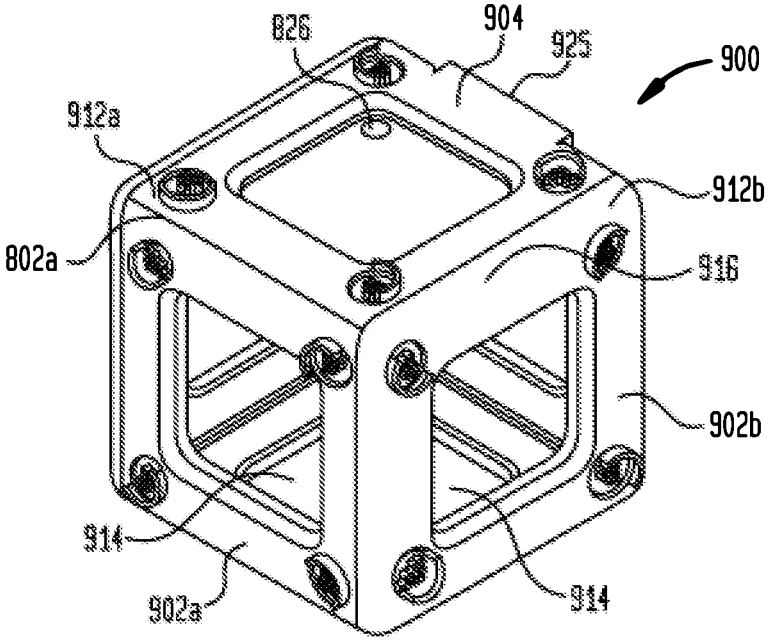
FIG. 9A depicts a perspective view of an assembled frame without a container for use with the container system depicted in FIG. 6 in accordance with one alternate embodiment of the present invention.
Figure 9B:
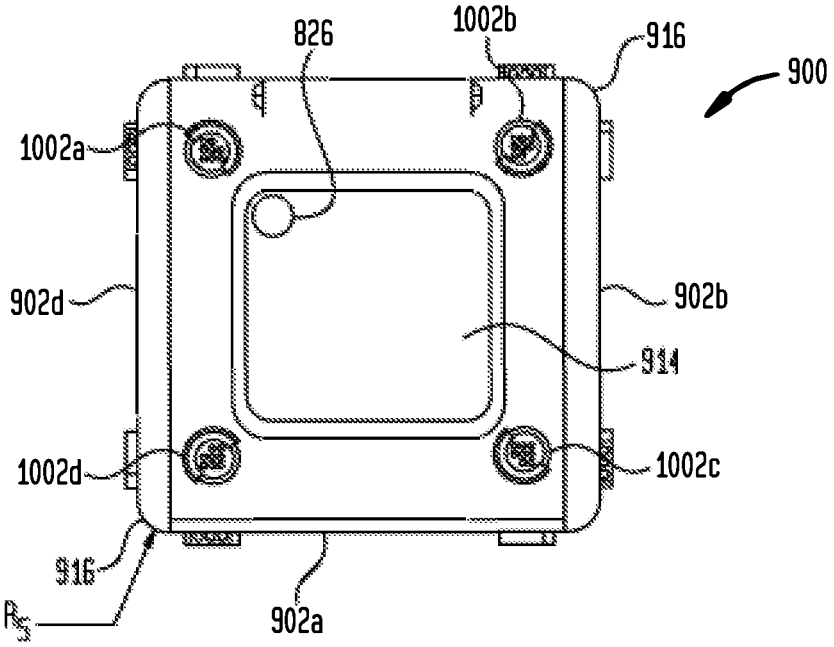
FIG. 9B depicts a top view of the assembled frame depicted in FIG. 9A without a container in accordance with one alternate embodiment of the present invention.
Figure 9C:
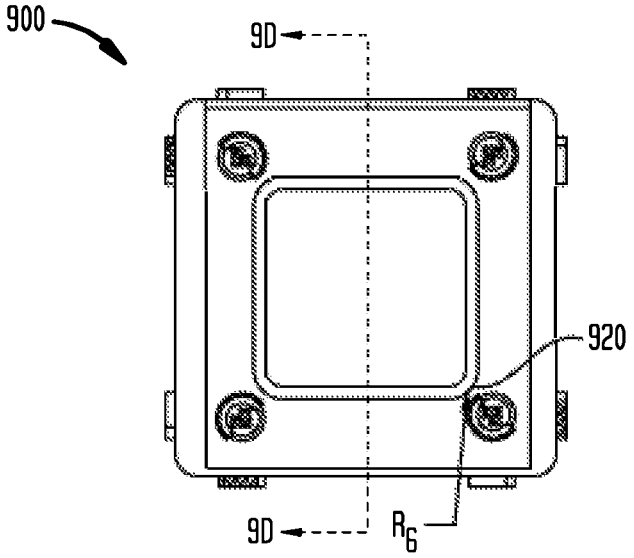
FIG. 9C depicts a side view of the assembled frame depicted in FIG. 9A through 9C without a container in accordance with one alternate embodiment of the present invention.
Figure 9D:
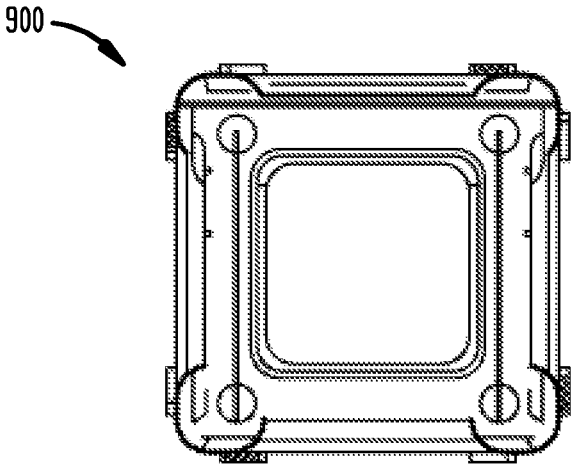
FIG. 9D depicts a cross-sectional view of the assembled frame depicted in FIGS. 9A through 9C taken along lines 9D-9D of FIG. 9C in accordance with one alternate embodiment of the present invention.

Referring now to FIGS. 9A through 9D, depicted are perspective, top, side, and cross-sectional views of frame 604 in accordance with an alternate embodiment of the present invention. The cross-sectional view of FIG. 9D is taken along lines 9D-9D of FIG. 9C.

Assembled frame 900 includes frame sides 902, frame top 904, and frame bottom 906. Sides 902*b* and 902*d* are substantially square with the exception of rounded edges 916 on all four sides thereof and substantially centralized, substantially square openings 914. Each of the sides 902*b* and 902*d* is approximately 2.732 inches square (See FIG. 8A, dimension $D_4$). However, other shapes and sizes may be substituted without departing from the scope hereof.

In the depicted embodiment, rounded edges 916 have a radius $R_5$ of approximately 0.215 inches, however, alternate radii may be substituted without departing from the scope hereof.

Substantially centralized, substantially square openings 914 also have rounded corners 920, however, non-rounded corners may also be utilized. In the depicted embodiment, rounded corners 920 have a radius $R_6$ of approximately 0.084 inches, however, alternate radii may be substituted without departing from the scope hereof. Openings 914 allow the user to view a container inserted into frame 604 therethrough such as container 602 as discussed herein.

Each frame side 902, frame top 904, and frame bottom 906 includes (4) substantially identical connectors 1002 having varying orientations that protrude from each corner thereof, however, alternate quantities may be substituted and/or connectors may be omitted from one or more of frame side 902, frame top 904, and frame bottom 906 without departing from the scope hereof. Connectors 1002 are discussed in greater detail below with respect to FIGS. 10A through 10D.

Figure 8B:
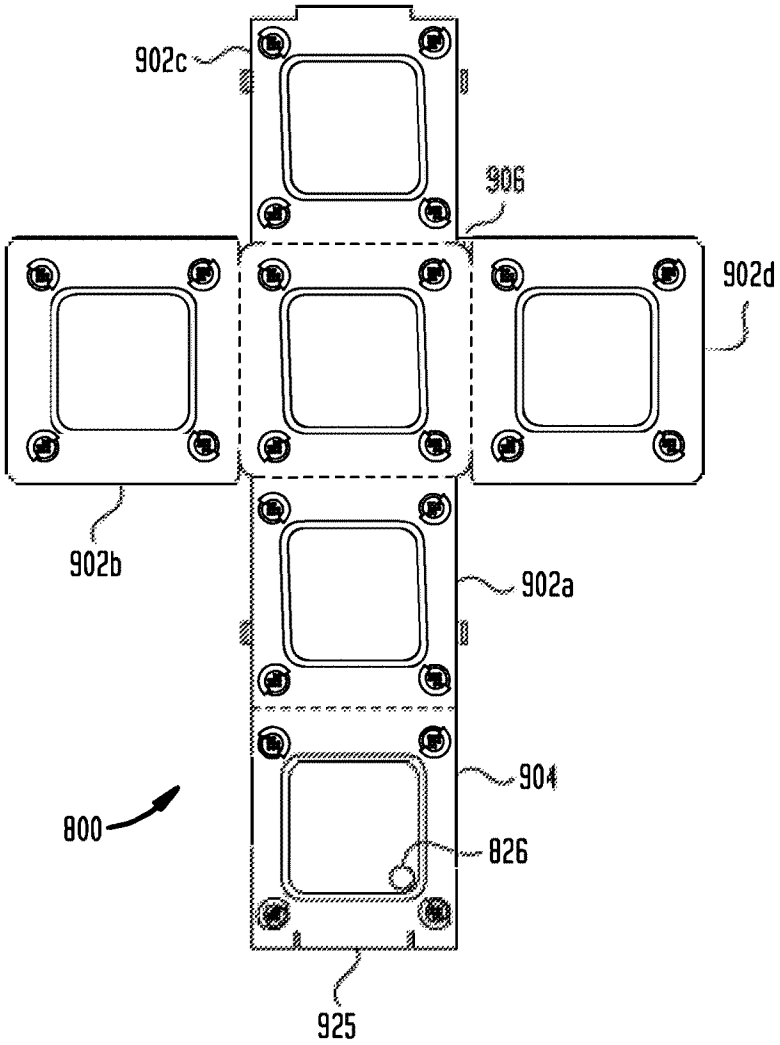
FIGS. 8A and 8B depict top and bottom views, respectively, of an unassembled frame for use with the container system depicted in FIG. 6 in accordance with one alternate embodiment of the present invention.
Figure 8A:
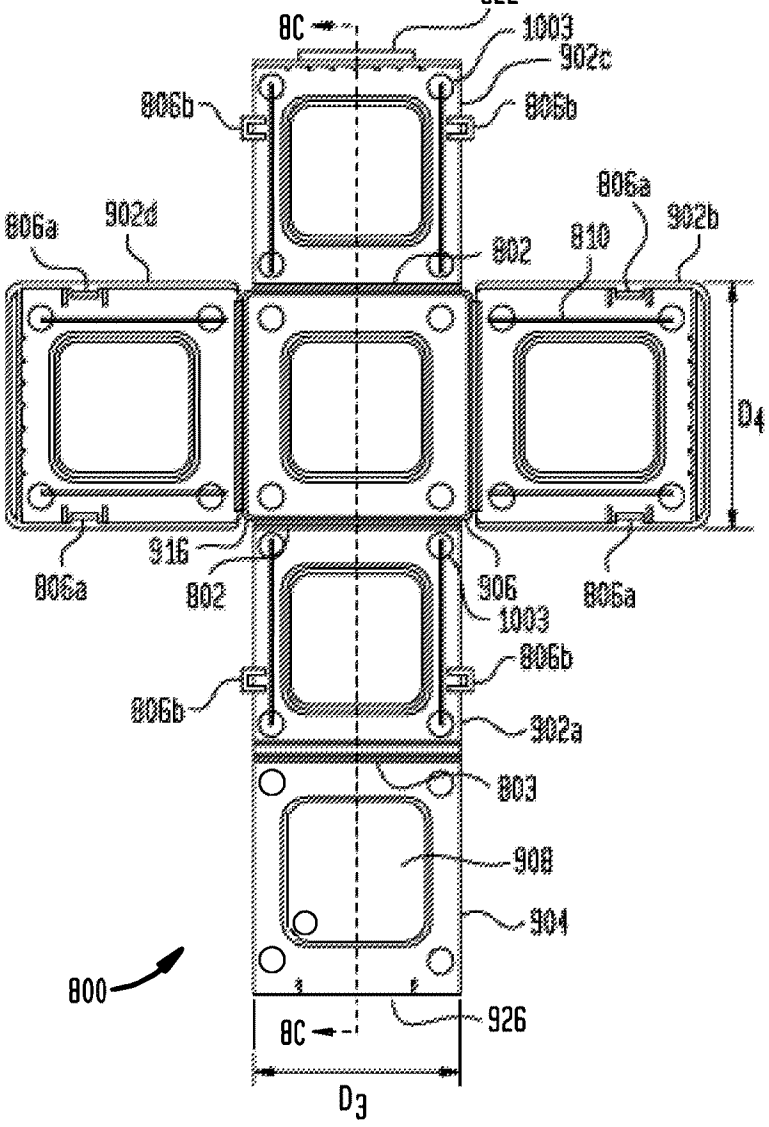

Sides 902*a* and 902*c* and bottom 906 are substantially square with the exception of substantially centralized, substantially square openings 914 as best seen in the unassembled top and bottom views of FIGS. 8A and 8B, respectively. Each of the sides 902*a* and 902*c*, and frame bottom 906, is approximately 2.332 inches square (See FIG. 8A, dimension $D_3$). However, other shapes and sizes may be substituted without departing from the scope hereof. Frame side 902*c* also includes frame tab 922 that is received by frame receptacle 926 of top 904 to lock frame tab 922 in place until pressure is applied to lift 925 by the user to facilitate locking and unlocking of top 904 to side 902*c*.

As depicted in FIGS. 8A and 8B, prior to assembly, frame 900 is manufactured as one relatively flat unassembled frame 800, wherein frame bottom 906 is coupled to frame sides 902*a, b, c*, and *d* via hinged sections 802, the latter of which allow the frame to be folded to the form shown in FIGS. 9A through 9D. That is, hinged sections 802 are manufactured and/or designed for motion during the assembly process only as is known in the art, after which frame 604 and the corresponding hinged sections 802 remain substantially locked in place in the form shown in FIGS. 9A through 9D.

Figure 8C:
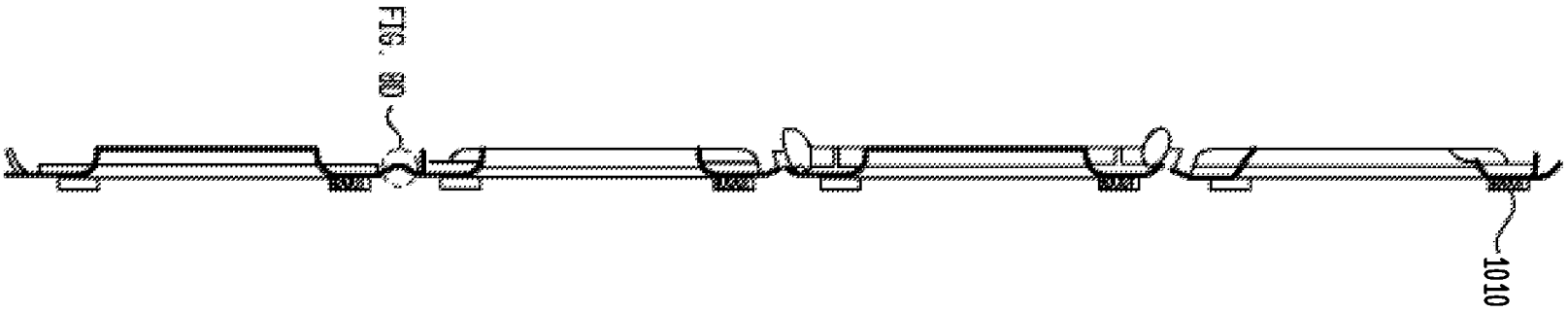
FIG. 8C depicts a cross-sectional view of the unassembled frame depicted in FIGS. 8A and 8B taken along lines 8C-8C of FIG. 8A.
Figure 8D:
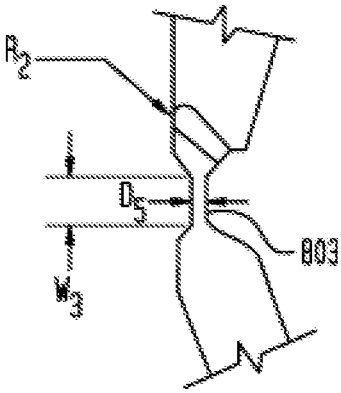
FIG. 8D depicts an enlarged view of the frame top hinged section of the unassembled frame of FIGS. 8A through 8C.

Similarly, side 902*a* is coupled to top 904 via a hinged section 803, the latter of which is best seen in the cross-sectional and detailed views of FIGS. 8A, 8C and 8D. In contrast to hinged sections 802, hinged section 803 is a "living" hinge that is manufactured and/or designed for continuous use by the user of container system 600. Specifically, hinged section 803 allows the user to rotate frame top 904 upward such that the user may access the interior of container 602.

As seen in FIG. 8D, hinged section 803 has a width $W_3$ of approximately 0.04 inches, a depth $D_5$ of approximately 0.008 inches and transition frame top 904 to frame side 902*a* with a radius $R_2$ of 0.029 inches. However, alternate dimensions may be substituted without departing from the scope hereof. Each hinged section 802 and 803 extends substantially throughout the length of the corresponding frame top 904, frame side 902, and/or frame bottom 906 to which it is connected with the exception of rounded edges 916. However, alternate lengths may be substituted without departing from the scope hereof.

Unassembled frame 800 includes eight (8) substantially linear ribs 810. More specifically, in the depicted embodiment, sides 902*a, b, c*, and *d* each include a pair of ribs 810, and each one of the pair of ribs 810 extends vertically between the locations of the left and right pairs of connectors 1002, except that the connectors 1002 are located on the external surface of frame 800 (as best seen in FIG. 8B) and the ribs are located on the interior surface of frame 800 (as depicted in FIG. 8A). Also in the depicted embodiment, each ridge 810 extends from the bottommost center point of the location of lower connector 1002 upwards to the midpoint of the location of upper connector 1002. However, alternate quantities and locations for ribs 810 may be substituted without departing from the scope hereof. In the depicted embodiment, ribs 810 are located such that they form a tight fit with container 602 when it is inserted into an assembled frame 900. That is, ribs 810 abut the sides of face 716 and rest against the indented edges 710 and 711 to hold container 602 securely within frame 604. Ribs 810 also add strength to sides 902 to allow such sides to be constructed with less weight and thinner than a comparable side without ribs 810.

When frame 900 is assembled, hinged sections 802 and 803 are folded such that the cube shape depicted in FIG. 9A is obtained. Frame 900 is held in its cube shape via fasteners 806, which include female fastener sections 806*a* and male fastener sections 806*b*. Female and male faster sections 806*a* and 806*b* are merely snapped together to removably or irremovably retain the shape of frame 900.

In the depicted embodiment, prior to the completion of assembly of frame 604, any desired labels 730 are applied to container 602, and container 602 is inserted into frame 604. Thereafter, frame top 904 is snapped together with frame sides 902, and container 602 is irremovably trapped within frame 604 to form interconnectable connection system 600.

However, alternate embodiments are envisioned in which container 602 is able to be removed from frame 604.

In the depicted embodiment, frame 604 is made of polypropylene plastic and injection molding. However, other materials and methods of manufacturing frame 604 may be substituted without departing from the scope hereof. Also, other methods of assembling frame 900 may be substituted including, without limitation, blow molding, 3D printing, or the like.

Frame top 904 is also substantially square as best seen in the unassembled top and bottom views of FIGS. 8A and 8B, respectively. Frame top is approximately 2.332 inches square (See FIG. 8A, $D_3$). However, other shapes and sizes may be substituted without departing from the scope hereof. Frame top 904 does not include a substantially centralized, substantially square opening 914, however, frame top 904 includes a substantially centralized, substantially square recess 908 that is approximately equivalent in size to openings 914. The edges of recess 908 also include rounded edges 920.

In one embodiment of the present invention, frame top 904 also functions to retain a straw or the like in an upright position during consumption of a consumable liquid by the user. In such embodiments, frame top 904 may include access aperture 826 to indicate a preferred location to pass a straw or the like through top 904 such that it may puncture container 602 as discussed in greater detail above. In the depicted embodiment, access aperture 826 is circular, however, other types, quantities, and locations of access apertures may be substituted without departing from the scope hereof. Also, an access aperture is not required to implement the present invention as the user may also have the ability, for example, to open top 904.

In some embodiments of the present invention such as that depicted in FIGS. 6 through 10D, frame top 904 includes frame lift 925 to facilitate opening and closing of frame top 904. In one form, frame lift 925 is made of the same material as frame top 904 and it is simply an extended piece thereof. In the depicted embodiment, frame lift 925 has a width approximately equal to the width of opening 914, however, other widths may be substituted.

Side 902*c* also includes frame tab 922, which may be any type of protrusion or the like capable of mating with frame tab receptacle 926, the latter of which is located below or underneath frame lift 925. That is, frame tab 922 may be pushed into frame tab receptacle 926 via the closing of top 904 and application of pressure thereto, after which it is held therein via the pressure exerted on frame tab 922 by the interior walls of frame tab receptacle 926 until pressure is applied in an opposite, unlocking direction to remove frame tab 922 from frame tab receptacle 926 (e.g., pressure may be applied via a fingernail or the like). Although a snapping type frame tab is utilized in the depicted embodiment, other tabs may be substituted without departing from the scope hereof.

As best seen in FIGS. 8C and 8D, frame top 904 is connected to frame side 902*a* via hinged section 803 as described in greater detail herein. Hinged section 803 allows frame top 904 to pivot to any point located between a fully open position and a fully closed position (i.e., one in which frame tab 922 is coupled to frame tab receptacle 926). Opening of top 904 via frame lift 925 or the like allows a user to access container 602, for example, to remove container top 704 or the like. Once, container top 704 is removed, a user may access the contents of cavity 718 for storage, cleaning, or the like.

FIG. 9A depicts a perspective view of container system 600 in which frame top 904 is fully closed. This figure is for illustration purposes only as, in the depicted embodiment, container 602 is inserted into frame 604 before frame 604 is fully assembled and female and male faster sections 806*a* and 806*b* are connected to each other. In a closed position, frame top 904 protects top 704 of container 602 when container system 600 is not in use. Alternatively or additionally, frame top 904, when closed, allows container system 600 to function as a substantially cubic building block. Also, the re-closure ability of frame top 904 allows a child to store items within cavity 718 (possibly after cavity 718 has been cleaned of any initial consumable item). However, embodiments of the present invention are envisioned in which frame top 904 or portions thereof are omitted. In one such embodiment, frame top 904 is substantially identical to frame sides 902 or frame bottom 906 of frame 900 such that a substantially square aperture is centrally located therein. Further, although frame top 904 includes connectors 1002, frame tops 904 without connectors are also envisioned.

Although a substantially cube-shaped container system having six surfaces (i.e., four sides, one top, and one bottom) is depicted in FIGS. 6 through 10D, other shapes and surface quantities may be substituted without departing from the scope of the present invention. That is, the exemplary alternate embodiment depicted in FIGS. 1-4 and FIGS. 6 through 10D are not intended to limit the scope of any characteristic of a container or container system of the present invention with respect to its particular shape, size, dimension, wall thickness or any other characteristic, instrumentality, or method of use.

Although sides 902, frame top 904, and frame bottom 906 are each shown with four (4) connectors, alternate connector quantities may be substituted without departing from the scope hereof. Further, alternate embodiments are envisioned in which one or more of the aforementioned members have a different quantity of connectors than the remaining members.

Figure 10A:
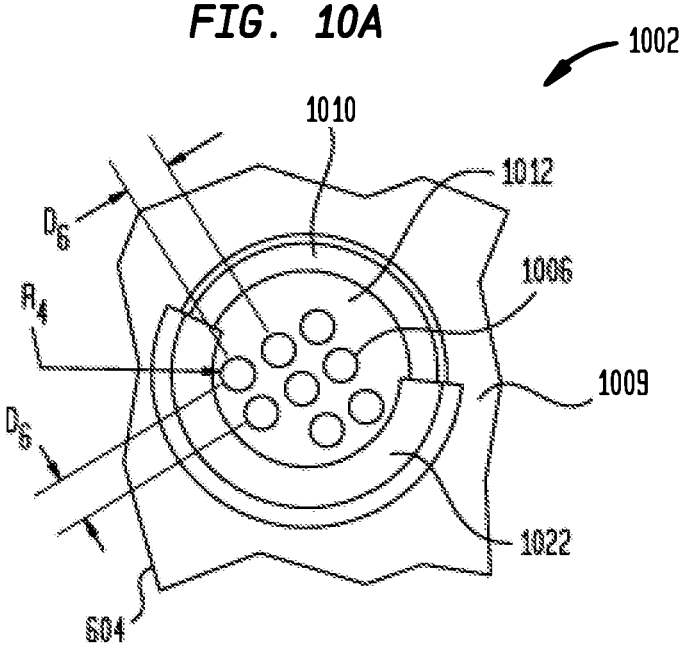
FIG. 10A depicts a top view of a connector of the frame depicted in FIGS. 9A through 9D in accordance with one alternate embodiment of the present invention.

Turning now to FIG. 10A, depicted is a top view, respectively, of connector 1002 in accordance with one embodiment of the present invention. In the depicted embodiment, substantially circular connectors 1002 are formed via molding during the molding of frame 604 such that connectors 1002 form an integral part thereof. However, alternate embodiments are envisioned in which connectors are formed separate from frame 604 and later attached thereto.

Figure 10B:
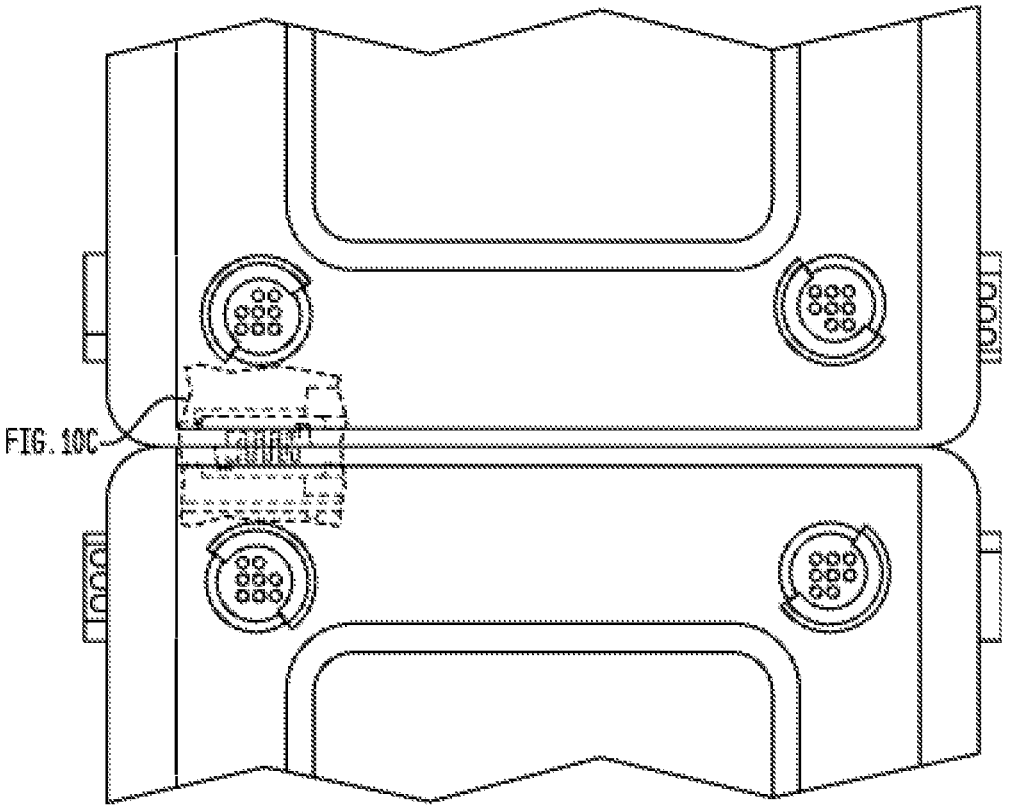
FIG. 10B depicts cutaway views of a first container system coupled atop a second container system.
Figure 10C:
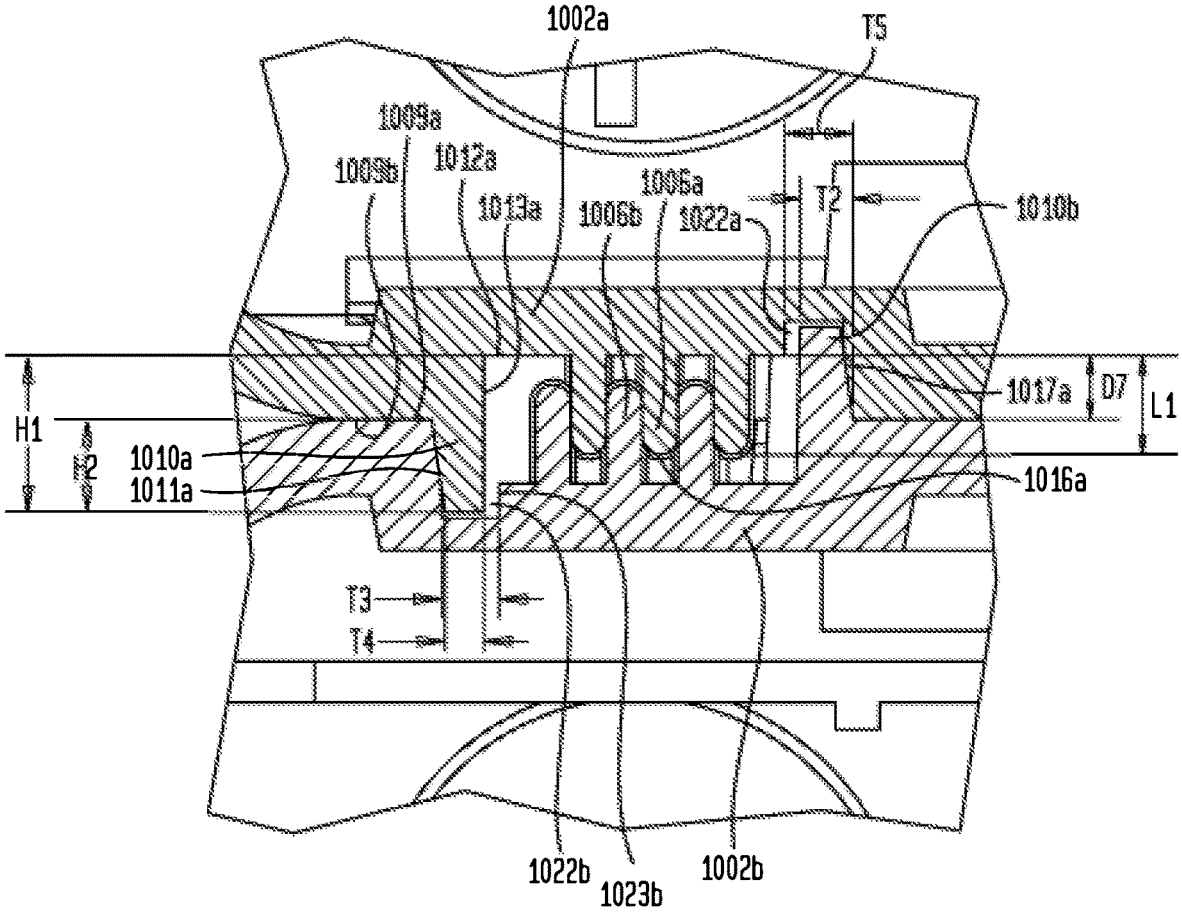
FIG. 10C depicts a cross-sectional side view of two connectors mated with each other in accordance with one alternate embodiment of the present invention.
Figure 10D:
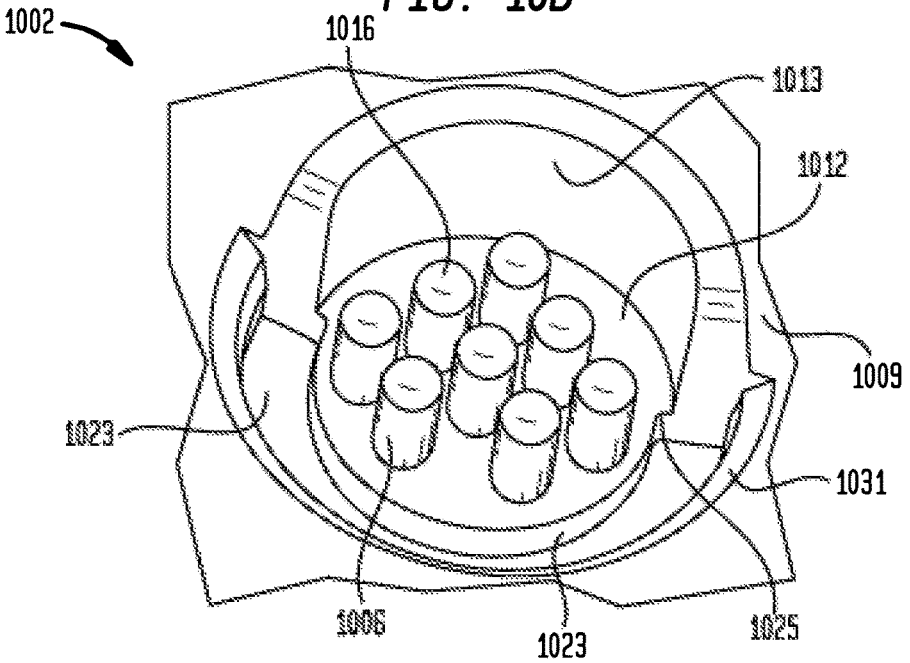
FIG. 10D depicts an angled view of a connector of the frame depicted in FIGS. 9A through 9D in accordance with one alternate embodiment of the present invention.

As best seen in the top and angled views of FIGS. 10A and 10D, connector 1002 is molded such that each connector includes a connector floor 1012, a plurality of bristles 1006, a protrusion 1010, and a channel 1022.

Connector floor 1012 is substantially circular with the exception of a semicircular indentation caused by the adjacent channel 1022. That is, innermost wall 1023 of channel 1022 is located at a slightly closer proximity to the centerpoint of floor 1012 than inner wall 1013 of protrusion 1010, thereby causing semicircular indentation 1025. In the depicted embodiment, floor 1012 is recessed below the exterior surface of frame 604 at a depth $D_7$ of approximately 0.05 inches, but alternate depths and shapes may be substituted without departing from the scope hereof.

Channel 1022 is substantially semicircular, extends around half of the perimeter of floor 1012, and is recessed below floor 1012. Semicircular channel 1022 is shaped such that it mates with semicircular protrusions 1010 of mating connectors as best seen in the cross-sectional view of FIG. 10C. In the depicted embodiment, channel 1022 has a thickness $T_3$ of approximately 0.047 inches at its base and exterior wall 1017*a* of channel 1022 tapers outward as it extends upward such that the thickness $T_5$ at the top of channel 1022 is approximately 0.08 inches. However, alternate thicknesses and tapering may be substituted without departing from the scope hereof.

A modified array of bristles 1006 extends outward from floor 1012. Bristles 1006 have a length $L_1$ of approximately 0.08 inches, however, alternate lengths may be substituted without departing from the scope hereof. A plurality of bristles 1006 are arranged in a substantially centralized modified three by three array. The array is modified in that corner bristle located adjacent and internal to the approximate midpoint of channel 1022 is omitted (i.e., the array includes eight bristles, not nine). In the depicted embodiment, bristles 1006 have a radius $R_4$ of approximately 0.02 inches and the centers of bristles 1006 are offset from the centers of adjacent bristles 1006 by a distance $D_6$ of 0.057 inches, however, other bristle quantities, radii, and distances may be substituted without departing from the scope hereof.

Semicircular protrusion 1010 also extends from floor 1012, and has a height $H_1$ of approximately 0.125 inches, which causes protrusion 1010 to extend beyond outwardly facing surface 1009 of frame 604 by a height $H_2$ of approximately 0.075 inches. Protrusion is substantially semicircular and extends around approximately half of the perimeter of floor 1012. Protrusion has a thickness $T_2$ of approximately 0.045 inches at its base and exterior wall 1011 of protrusion 1010 tapers inward as it extends upward such that the thickness $T_4$ at the top of protrusion 1010 is approximately 0.03 inches. However, alternate thicknesses and tapering may be substituted without departing from the scope hereof.

In the depicted embodiment, each side of frame 604 includes four connectors 1002, however, each connector is oriented in a different manner. More specifically, each connector 1002 is rotated 90 degrees clockwise relative to the connector located to its adjacent, counterclockwise side. This is best illustrated in FIG. 9B. Connector 1002*b* is rotated 90 degrees clockwise related to the connector located to its adjacent, counterclockwise side, namely, connector 1002*a*. Similarly, connector 1002*d* is rotated 90 degrees clockwise related to the connector located to its adjacent, counterclockwise side, namely, connector 1002*c*. The varying orientations allow each side of frame 604 to be connected with any other side of frame 604 regardless of the orientation of the latter. That is, top left connector 1002*a* is oriented to be substantially inverse to top right connector 1002*b*, and bottom left connector 1002*c* is oriented to be substantially inverse to connector 1002*d* such that when two sides are mated to each other, connector 1002*a* mates with connector 1002*b*, and connector 1002*c* mates with connector 1002*d*. However, alternatively, top left connector 1002*a* is capable of mating with any of the other connectors 1002*a* through 1002*d* of a mating container system (i.e., depending on the orientation of the container system, one connector can mate with any of the other connectors), thereby allowing the blocks to be connected to each other regardless of orientation. In this manner, each of the connectors is able to mate with any one of the other connectors depending on the orientation of the mating container system.

As best seen in the cross-sectional view of FIG. 10C which depicts two mating connectors, bristles 1006*a* of a first connector 1006*a* mate with inversely situated bristles 1006*b* of a second connector 1006*b* to which it is being mated. Also, semicircular protrusion 1010*a* mates with semicircular channel 1022*b*. The inverse arrangement of bristles 1006 also positions the bristles on the mating connectors such that each bristle 1006*a* on a first connector 1002*a* fits between, or adjacent to, one or more bristles 1006*b* on the second connector 1002*b* (to which the first connector is being mated).

Additionally, semicircular protrusion 1010*a* of the first connector 1002*a* combines with the inversely oriented semicircular protrusion 1010*b* of the second connector 1002*b* to form a substantially circular protrusion. The creation of the substantially circular protrusion by the two mated semicircular protrusions 1010 lock the connectors 1002 in place and maximize the potential for, and facilitate, correct alignment by preventing angular rotation thereof. That is, each semicircular protrusion 1010 prevents rotational movement of the mating semicircular protrusion 1010 since the ends of each abut each other and form a relatively tight fit that eliminates any space for movement therebetween. Also, semicircular channel 1022 also acts to minimize or prevent dislodgement or rotational movement of the semicircular protrusion 1010 positioned therein.

The inverse arrangement of the connectors 1002 allows each connector 1002 to mate with every other connector 1002 such that the container systems 600 may be interconnected, or "built" together, in any number of ways. In this manner, container systems 600 function as toy blocks that may be arranged and interconnected as desired by the user without the need for the ability to match a female component to a male component.

Also, although the depicted connectors 1002 each include one protrusion 1010 and eight (8) bristles 1006 positioned in an inverse arrangement, alternate quantities and/or patterns for the protrusions and/or the bristles may be substituted without departing from the scope hereof. Similarly, although bristles 1006 of FIGS. 10A and 10B are depicted as parallel, other embodiments of the invention are envisioned in which bristles 1006 are not parallel. Further, the distribution of bristles 1006 may occur in a random or organized manner. Also, bristle tips 1016 may be rounded or pointed to facilitate sliding together, or interconnecting, of opposing bristles. Further, although FIGS. 10A, 10B, and 10D depict a connector that includes substantially cylindrical bristles with rounded bristle tips 1016, connectors may be substituted having any one or more of the following characteristics: a greater or lesser quantity of bristles; longer or shorter bristles relative to the depicted base thickness; thicker or thinner bristles relative to the base thickness; bristles having varying degrees of flexibility; bristles having varying diameters; bristles having round, square, and/or polygonal shafts or a combination thereof; a combination of parallel and non-parallel bristles; wedge-shaped bristles, varying base anchoring, bristles anchored in bundles, and combinations thereof. In addition, some bristles may be coated with a friction-modifying substance.

Although the embodiment depicted in FIGS. 6 through 10D includes bristle-type connectors 1002, connectors without bristles may be substituted without departing from the scope hereof including, without limitation, Velcro® connectors, magnetic connectors, male and female mating connectors, pin and tail connectors, tongue and groove connectors, mortise and tenon connectors, and reversible adhesive connectors.

Container system 600 may be utilized in the same manner as discussed above for container 100. For example, they may be assembled to form an object such as that shown in FIG. 4. It is envisioned that a plurality of container systems 600 including labels 730 or the like may be connected in a manner that allows the user to spell words or perform other educational activities. Also, container systems 600 may be in the form of juice boxes or other beverage boxes for use by children. In such an embodiment, container systems 600 may be connected as shown in FIG. 4 (i.e., to form a substantially rectangular object) to facilitate packaging, packing, display, and shipment of the containers prior to sale to an end user. Container systems 600 may also be utilized in lieu of container 100 to practice method 500 as depicted in FIG. 5 and as described in greater detail above.

Figure 11A:
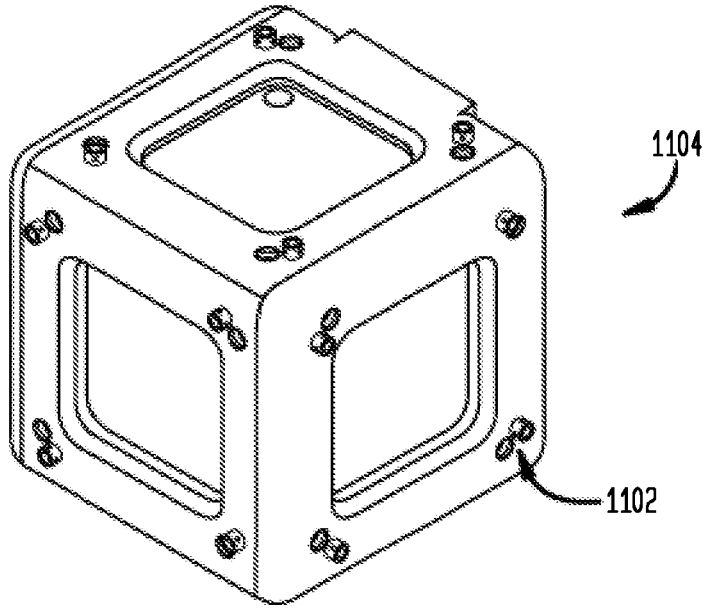
FIG. 11A depicts a perspective view of the frame depicted in FIGS. 6 and 8A through 9D with an alternate plug connector in accordance with an alternate embodiment of the present invention.
Figure 11B:
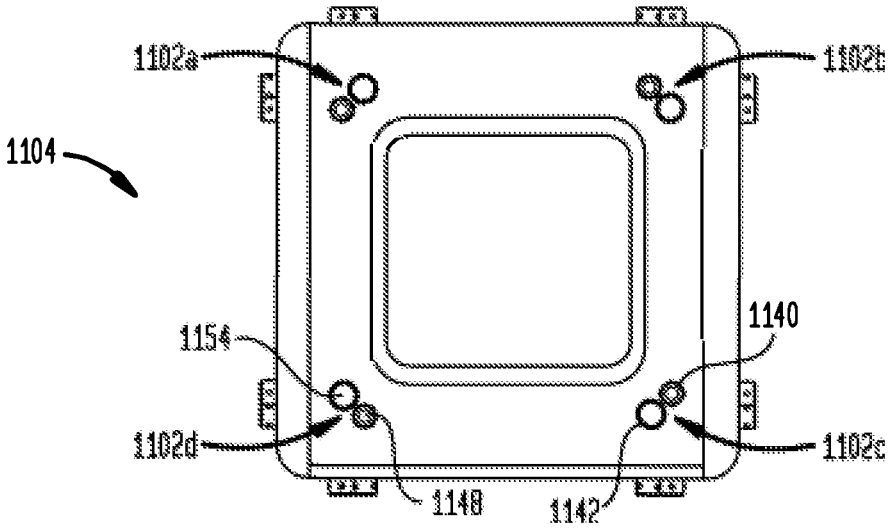
FIG. 11B depicts a side view of the frame depicted in FIG. 11A in accordance with an alternate embodiment of the present invention.
Figure 11C:
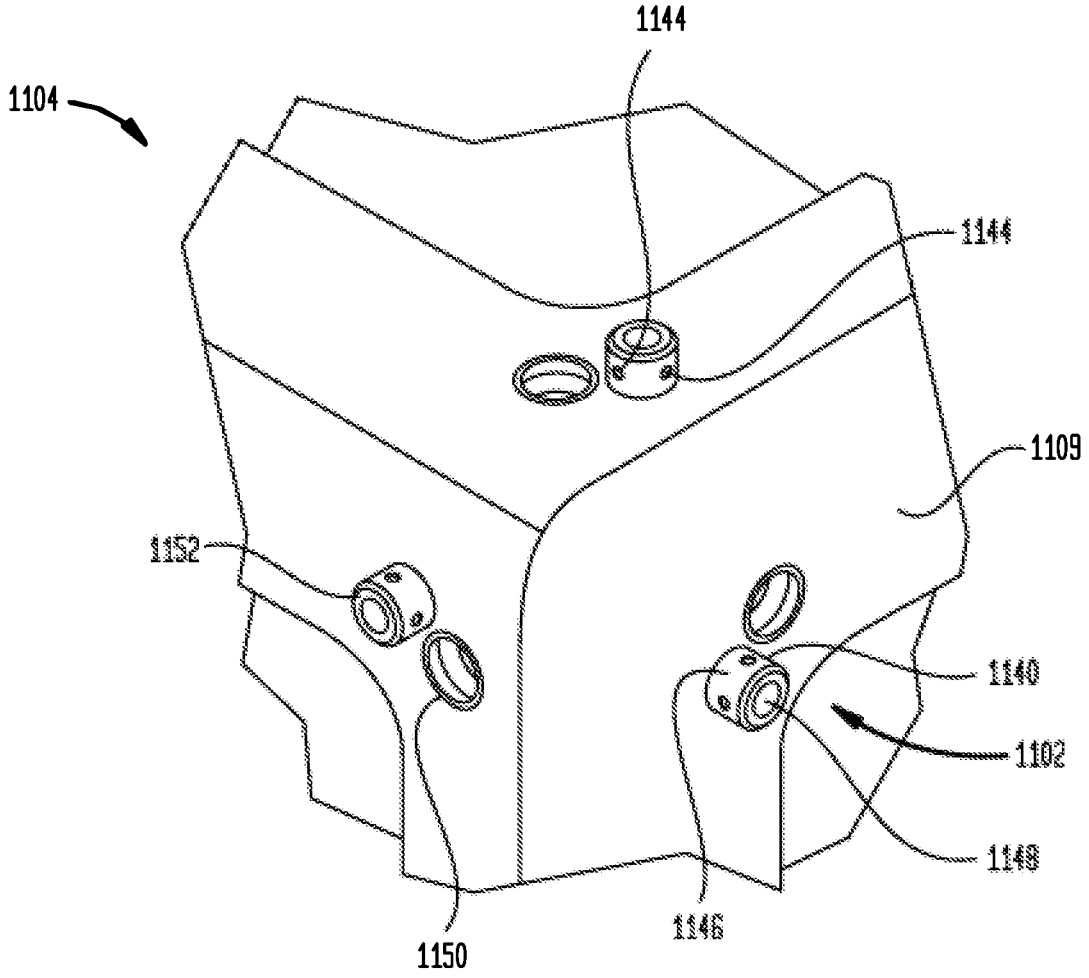
FIG. 11C depicts an enlarged, cutaway view of three connectors of the frame depicted in FIGS. 11A and 11B in accordance with an alternate embodiment of the present invention.

Turning next to FIGS. 11A, 11B, and 11C, depicted are perspective, side, and enlarged views of the exemplary interconnectable container system depicted in FIGS. 6 through 10D with an alternate plug connector in accordance with an alternate embodiment of the present invention. That is, all of the components of frame 1104 are identical to the corresponding components of frame 604, as described in greater detail above, with the exception of connector 1102.

In the depicted embodiment, plug connectors 1102 are formed via molding during the molding of frame 1104 such that connectors 1102 form an integral part thereof. However, alternate embodiments are envisioned in which the plug portion of the connector is formed separate from frame 1104 and later attached thereto and/or the socket portion of the connector is created after manufacturing of frame 1104 (e.g., via drilling or the like).

As best seen in the enlarged view of FIG. 11C, each connector 1102 includes one plug 1140 and one socket 1142, however, alternate quantities may be substituted without departing from the scope hereof. Alternate connectors are envisioned in which either the plug 1140 or the socket 1142 are omitted (i.e., some connectors include a plug only and the mating connectors include a socket only).

Plug 1140 is substantially cylindrical with a hollow core 1148, and it extends from the outwardly facing surface 1109 of frame 1104. Although the depicted plug 1140 is substantially cylindrical in the depicted embodiment, tapered plugs are also envisioned in which outwardly facing surface 1146 of plug 1140 tapers slightly inward as it extends away from outwardly facing surface 1109 of frame 1104 to facilitate engagement of plug 1140 with a socket 1142 of a mating connector. Also, alternate embodiments are envisioned in which plug 1140 is solid (i.e., it does not include a hollow core 1148). Furthermore, alternate non-cylindrical shapes may be substituted for plug 1140 without departing from the scope hereof.

In the depicted embodiment, distal end 1152 of plug 1140 is tapered on its outer edge such that the outermost circumference is slightly smaller than the circumference of the body of plug 1140. Such tapering facilitates alignment of plug 1140 with a mating socket 1142 during coupling of a pair of connectors. However, non-tapered edges may be substituted without departing from the scope hereof.

In the depicted embodiment, plug 1140 includes four (4) substantially semicircular protrusions 1144 arranged in an equidistant manner around the longitudinal midpoint of outwardly facing surface 1146 of plug 1140, however, these protrusions may be omitted or included in varying quantities and/or shapes without departing from the scope hereof.

Socket 1142 is a substantially cylindrical recess recessed below outwardly facing surface 1109 having a depth that is approximately equivalent to the height of plug 1140. In the depicted embodiment, edge 1150 of socket 1142 (i.e., the edge located adjacent to outwardly facing surface 1109 is tapered such that the outermost circumference is slightly larger than the innermost circumference of the body of socket 1142. This tapering provides a wider area in which to land plug 1140 within socket 1142. However, non-tapered edges may be substituted without departing from the scope hereof.

In the depicted embodiment, each side of frame 1104 includes four connectors 1102, however, each connector is oriented in a different manner. More specifically, each connector 1102 is rotated 90 degrees clockwise relative to the connector located to its adjacent, counterclockwise side. This is best illustrated in FIG. 11B. Connector 1102*b* is rotated 90 degrees clockwise related to the connector located to its adjacent, counterclockwise side, namely, connector 1102*a*. Similarly, connector 1102*d* is rotated 90 degrees clockwise related to the connector located to its adjacent, counterclockwise side, namely, connector 1102*c*. The varying orientations allow each side of frame 1104 to be connected with any other side of frame 1104 regardless of the orientation of the latter. That is, top left connector 1102*a* is oriented to be substantially inverse to top right connector 1102*b*, and bottom left connector 1102*c* is oriented to be substantially inverse to 1102*d* such that when two sides are mated to each other, connector 1102*a* mates with connector 1102*b*, and connector 1102*c* mates with connector 1102*d*. However, alternatively, top left connector 1102*a* is capable of mating with any of the other connectors 1102*a* through 1102*d* of a mating container system (i.e., depending on the orientation of the container system, one connector can mate with any of the other connectors), thereby allowing the blocks to be connected to each other regardless of orientation. In this manner, each of the connectors is able to mate with any one of the other connectors depending on the orientation of the mating container system.

A first connector 1102*a* mates with a second connector 1102*b* by simply inserting plug 1140 of connector 1102*a* into socket 1142 of connector 1102*b* while simultaneously inserting plug 1140 of connector 1102*b* into socket 1142 of connector 1102*a*. Insertion occurs until distal ends 1152 of plugs 1140 contact the respective floors 1154 of socket 1142. After insertion, protrusions 1144 help to retain the connectors in a mated position via friction.

In an alternate embodiment, plug 1140 may have a height slightly greater than the depth of socket 1142, and socket 1142 may include a substantially circular channel recessed below floor 1154. The depth of the channel may be approximately equivalent to the difference between the height of plug 1140 and the depth of socket 1142. The width of the channel may be approximately equivalent to the width of the wall of plug 1140. In such an embodiment, distal end 1152 of plug 1140 may enter the channel within socket 1142 to provide additional coupling of the two connectors. Such fit between the plug 1140 and the channel could be a friction fit or non-friction fit without departing from the scope hereof.

The inverse arrangement of the connectors 1102 allows each connector 1102 to mate with every other connector 1102 such that container systems utilizing frames such as frame 1104 may be interconnected, or "built" together, in any number of ways. That is, container systems utilizing frames such as frame 1104 may be utilized in the same manner as discussed above for container 100 and container systems 600. For example, they may be assembled to form an object such as that shown in FIG. 4. It is envisioned that a plurality of such container systems including containers with labels such as labels 730 or the like may be connected in a manner that allows the user to spell words or perform other educational activities. Or, such container systems may be connected as shown in FIG. 4 (i.e., to form a substantially rectangular object) to facilitate packaging, packing, display, and shipment of the containers prior to sale to an end user. Container systems utilizing frames such as frame 1104 may also be utilized in lieu of container 100 or container system 600 to practice method 500 as depicted in FIG. 5 and as described in greater detail above.

Referring now to FIG. 12A, depicted is a perspective view of an exemplary interconnectable container system 1600 in accordance with yet another alternate embodiment of the present invention. In the depicted embodiment of system 1600, the frame 1604 is nearly identical to frame 604 as described above, and it is designed to be compatible with a container nearly identical to container 602, with the following exceptions: 1) the frame 1604 and/or its compatible container such as container 602 are configured such that a container such as container 602 is removable from the frame 1604; 2) the substantially centralized, substantially square openings 914 are replaced with recessed frame surfaces 1602; and 3) the connectors have a different configuration.

With regards to the ability to remove a container such as container 602 from the frame 1604, frame 1604 is configured such that the top 1606 may be rotated upward at an angle of at least ninety degrees to allow removable of the container housed within frame 1604. More specifically, side 1901 is coupled to top 1606 via a hinged section 1903, in the same manner as which side 902*a* is coupled to top 904 via a hinged section 803 as described in greater detail herein with respect to FIGS. 8A, 8C and 8D. That is, hinged section 1903 is a "living" hinge that is manufactured and/or designed for continuous use by the user of container system 1600.

Specifically, hinged section 1903 allows the user to rotate frame top 1606 upward such that the user may insert and remove containers such as containers 602 and/or otherwise access the container 602 or the interior thereof (assuming the container top has been removed). Once, container 602 is removed, a user may access the frame cavity (i.e., the cavity located between the inwardly facings surfaces of the frame top, frame sides, and frame bottom) for storage, cleaning, or the like.

For example, in an embodiment in which the container is filled with a consumable item such as juice, the container 602 may be removed after the juice has been consumed, and the user may insert a new container 602 containing juice or the like and having a container top that is fully in tact (thereby preserving the consumable until it is ready to be consumed). This feature eliminates, or minimizes, the need to clean the interior of frame 1604 or the container contained therein. It also allows a user to store items in frame 1604 when no container is placed therein. Further, this feature allows the container system 1600 to be continually replenished with new consumable items with minimal effort on the part of the user.

With regards to the frame sides and frame bottom, the sides and bottom of frame 1604 do not include substantially centralized, substantially square openings such as the openings 914 discussed herein for frame 604. Rather, the sides 1901 and bottom of frame 1604 are solid (i.e., they do not contain any openings) and they include substantially centralized, substantially square recesses such as recess 1606. That is, frame 1604 is formed such that the sides and bottom are a single solid piece, however, a substantially centralized and substantially square portion thereof is recessed as depicted in FIG. 12.

In the depicted embodiment, the substantially centralized, substantially square recesses such as surface 1606 also has rounded corners 1920, however, this is not required. For example, non-rounded corners may also be utilized. In the depicted embodiment, rounded corners 920 have a radius $R_6$ of approximately 0.084 inches, however, alternate radii may be substituted without departing from the scope hereof.

Figure 12:
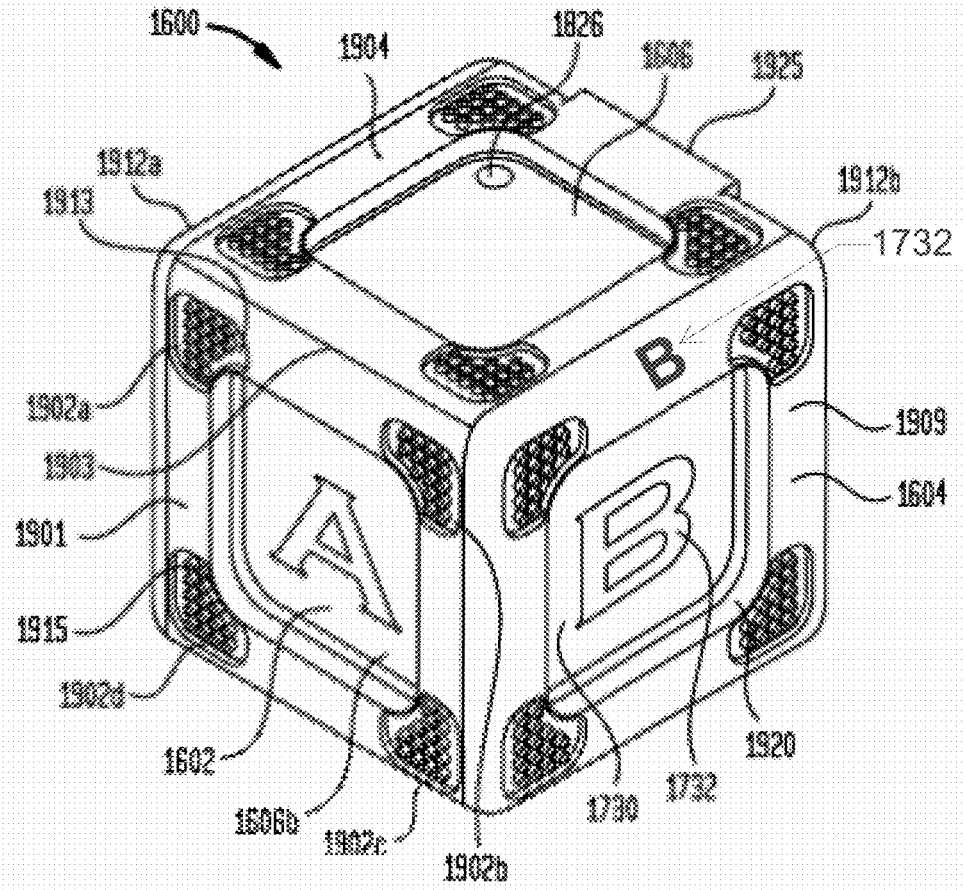
FIG. 12 is a perspective view of an exemplary interconnectable container system in accordance with yet another alternate embodiment of the present invention.

In the depicted embodiment shown in FIG. 12, the indicia 1732 and/or other artwork is applied to one or more recesses such as recess 1606 in the form of an adhesive-backed label 1730. In the depicted embodiment, label 1730 is the full size of recess 1606, but smaller labels may be substituted. In the depicted embodiment of the present invention, although label 1730 does not extend throughout the entire surface of side 1901, it extends throughout the entire surface of recess 1606. However, a label of such size is not required. Also, such label or the like may be permanent or removable, without departing from the scope hereof. However, indicia 732 and/or labels 730 may also be omitted from one or more of sides 1901 and/or the bottom of container 1901 without departing from the scope hereof. Also, indicia may be included in other forms including, without limitation, direct printing of the indicia on frame 1604.

As also depicted in FIG. 12, each frame side 1901, frame top 1606, and frame bottom (not shown) includes (4) substantially identical connectors 1902 having varying orientations that protrude from each corner thereof, however, alternate quantities may be substituted and/or connectors may be omitted from one or more of frame side 1901, frame top 1906, and frame bottom without departing from the scope hereof. Although frame bottom is not shown, it is substantially identical to frame bottom 906 with the exception that it includes a recess in lieu of an opening as described above, and its connectors are nearly identical to the connectors shown for frame sides 1901 and frame top 1606.

FIG. 12 depicts a perspective view of container system 1600 in which frame top 1904 is fully closed. As described in greater detail above with respect to container system 600, frame top 1904, when closed, allows container system 1600 to function as a substantially cubic building block. Also, the re-closure ability of frame top 1904 allows a child to store items within the frame cavity, container cavity, or both.

Although a substantially cube-shaped container system having six surfaces (i.e., four sides, one top, and one bottom) is depicted in FIGS. 6 through 12, other shapes and surface quantities may be substituted without departing from the scope of the present invention. That is, the exemplary alternate embodiment depicted in FIGS. 1-4 and FIGS. 6 through 12 are not intended to limit the scope of any characteristic of a container or container system of the present invention with respect to its particular shape, size, dimension, wall thickness or any other characteristic, instrumentality, or method of use.

As depicted in FIG. 12, connectors 1902 are molded such that each connector includes a connector floor 1913 and a plurality of bristles 1915. Connector floors 1913 are substantially square with rounded edges with the exception of a rounded indentation caused by its corresponding adjacent recess such as recess 1602 and 1606. In the depicted embodiment, floors 1913 are recessed below the exterior surface of frame 1604 at a depth of approximately 0.05 inches, but alternate depths and shapes may be substituted without departing from the scope hereof.

A modified array of bristles 1915 extends outwardly from floor 1913. Bristles 1913 have a length of approximately 0.08 inches, however, alternate lengths may be substituted without departing from the scope hereof. A plurality of bristles 1915 are arranged in a substantially centralized modified five by four array. The array is modified in that the five (5) corner bristles that would be located internal to the adjacent recess are omitted (i.e., the array includes fifteen bristles, not twenty). In the depicted embodiment, bristles 1915 have a radius of approximately 0.02 inches and the centers of bristles 1915 are offset from the centers of adjacent bristles 1915 by a distance $D_6$ of 0.057 inches, however, other bristle quantities, radii, and distances may be substituted without departing from the scope hereof.

In the depicted embodiment, each side of frame 1604 includes four connectors 1902, however, each connector is oriented in a different manner. More specifically, each connector 1902 is rotated 90 degrees clockwise relative to the connector located to its adjacent, counterclockwise side. For example, connector **1902*b* is rotated 90 degrees clockwise related to the connector located to its adjacent, counterclockwise side, namely, connector 1902*a*. Similarly, connector 1902*d* is rotated 90 degrees clockwise related to the connector located to its adjacent, counterclockwise side, namely, connector 1902*c*. The varying orientations allow each side of frame 1604 to be connected with any other side of frame 1604 regardless of the orientation of the latter. That is, top left connector 1902*a* is oriented to be substantially inverse to top right connector 1902*b*, and bottom left connector 1902*c* is oriented to be substantially inverse to connector 1902*d* such that when two sides are mated to each other, connector 1902*a* mates with connector 1902*b*, and connector 1902*c* mates with connector 1902*d*. However, alternatively, top left connector 1902*a* is capable of mating with any of the other connectors 1902*a* through 1902*d*** of a mating container system (i.e., depending on the orientation of the container system, one connector can mate with any of the other connectors), thereby allowing the blocks to be connected to each other regardless of orientation. In this manner, each of the connectors is able to mate with any one of the other connectors depending on the orientation of the mating container system.

The mating of the connector bristles 1915 is described in greater detail herein.

The inverse arrangement of the connectors 1002 allows each connector 1902 to mate with every other connector 1902 such that the container systems 600 may be interconnected, or "built" together, in any number of ways. In this manner, container systems 1600 function as toy blocks that may be arranged and interconnected as desired by the user without the need for the ability to match a female component to a male component.

Also, although the depicted connectors 1902 each include fifteen (15) bristles 1915 positioned in an inverse arrangement, alternate quantities and/or patterns for the bristles may be substituted without departing from the scope hereof. Similarly, although bristles 1915 are substantially parallel, other embodiments of the invention are envisioned in which bristles 1915 are not parallel. Further, the distribution of bristles 1915 may occur in a random or organized manner. Also, bristle tips 1915 may be rounded or pointed to facilitate sliding together, or interconnecting, of opposing bristles. Further, although the bristles 1915 of FIG. 12 are substantially cylindrical bristles with rounded bristle tips such as tips 1016, connectors may be substituted having any one or more of the following characteristics: a greater or lesser quantity of bristles; longer or shorter bristles relative to the depicted base thickness; thicker or thinner bristles relative to the base thickness; bristles having varying degrees of flexibility; bristles having varying diameters; bristles having round, square, and/or polygonal shafts or a combination thereof; a combination of parallel and non-parallel bristles; wedge-shaped bristles, varying base anchoring, bristles anchored in bundles, and combinations thereof. In addition, some bristles may be coated with a friction-modifying sub stance.

Although the embodiment depicted in FIGS. 6 through 12 includes bristle-type connectors 1002, connectors without bristles may be substituted without departing from the scope hereof including, without limitation, Velcro® connectors, magnetic connectors, male and female mating connectors, pin and tail connectors, tongue and groove connectors, mortise and tenon connectors, and reversible adhesive connectors.

Although sides 1901, frame top 1904, and frame bottom each include four (4) substantially identical connectors, alternate connector quantities may be substituted without departing from the scope hereof. Further, alternate embodiments are envisioned in which one or more of the aforementioned members have a different quantity of connectors than the remaining members and/or a combination of differing connectors are included on frame 1604.

Container system 1600 may be utilized in the same manner as discussed above for containers 100 and 600. For example, they may be assembled to form an object such as that shown in FIG. 4. It is envisioned that a plurality of container systems 1600 including labels 730 or the like may be connected in a manner that allows the user to spell words or perform other educational activities. Also, container systems 1600 may be in the form of juice boxes or other beverage boxes for use by children. In such an embodiment, container systems 1600 may be connected as shown in FIG. 4 (i.e., to form a substantially rectangular object) to facilitate packaging, packing, display, and shipment of the containers prior to sale to an end user.

Figure 13:
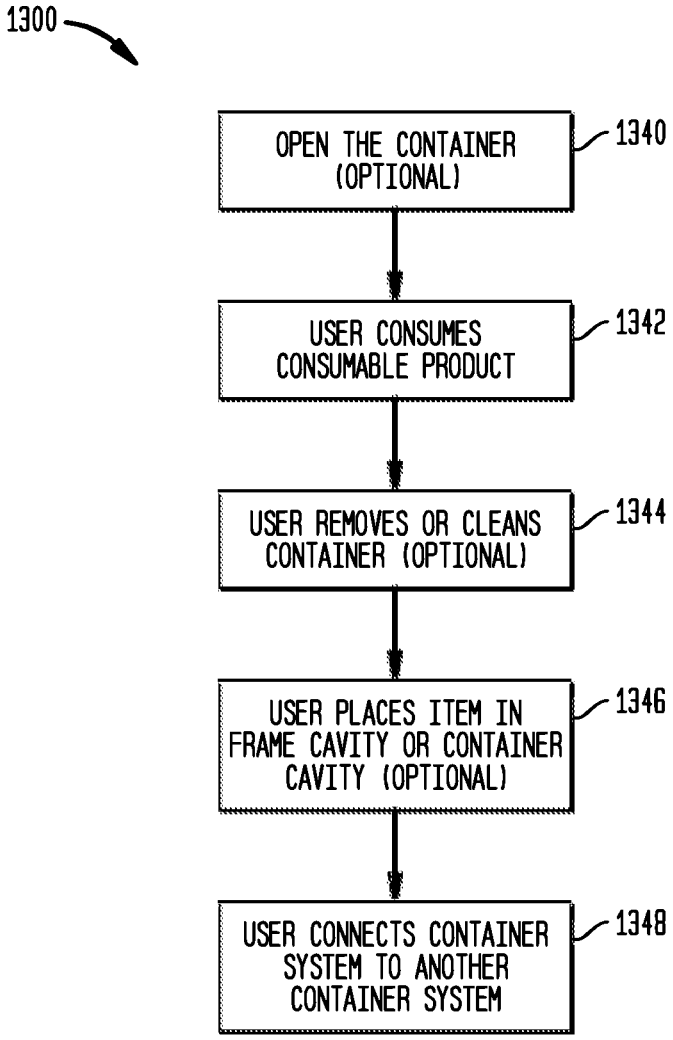
FIG. 13 is a flowchart of one alternate method of using a container in accordance with one embodiment of the present invention.

Referring now to FIG. 13, container systems 1600 may be utilized to practice a method such as method 1300. First, at 1340, the user optionally opens the container. This step may not be required in some embodiments of the present invention in which the consumable product is accessible without opening of the container such as is the case with container system 1600 as depicted in FIG. 12. That is, when utilizing a container system such as container system 1600, the user skips step 1340 and merely inserts a straw through access aperture 1826 and frame top 1904 as discussed in greater detail herein. Next, at 1342, a user consumes the consumable product contained in at least one container. This step optionally includes removing the seal of the container held within the frame and/or opening the frame top/cover.

Thereafter, at 1344, a user may remove the container and/or clean the container and/or container system; however, this is not required to implement the present invention. In a scenario in which the user wishes to remove the container, the user may simply open the frame top, remove the container, and lock the frame top in a closed position after the removal is complete. Optionally, the user may wish to clean the frame after the container is removed.

Or, if the user wishes to clean the container and reuse it, the user may, for example, remove the container, remove the container top (if still intact), clean the container, optionally clean the frame, reinsert the clean container into the frame, and lock the frame top in a closed position.

If a user skips the cleaning step, the user may still lock the frame top in place to create an intact building block with no partially open frame tops.

Next, at 1346, a user may optionally place one or more consumable or non-consumable items in a cavity for enjoyment or storage. For example, in a scenario in which the container was removed at step 1344, the user may insert a new container at step 1346 into the frame cavity. This new container may include, for example, a consumable item sealed therein. Or, the user may leave the frame cavity without a container and utilize it to store non-container items. Or, alternatively, if the user cleaned the container at step 1344, the user may place one or more items in the cavity of the cleaned container and/or the frame cavity.

Next, at 1348, a user may removably or irremovably connect an empty or filled first container with one or more empty or filled second containers to create an object (i.e., the second filled container may be one initially filled with a consumable item or one that was filled by the user after removal of the consumable item and/or cleaning of the cavity).

After process 1300 is complete, in embodiments of the present invention in which the connectors are removably connected, a user may change or disassemble the object and the user may re-use the containers to create one or more new objects.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A building block toy adapted to contain an item, the building block toy comprising:

a frame for enclosing said item, said frame including a plurality of frame sides, a frame bottom, and a frame top, each of the plurality of frame sides couplable to each adjacent frame side, the frame bottom couplable to at least a first group of the plurality of said frame sides, and the frame top couplable to at least a second group of the plurality of said frame sides;

wherein each of said frame sides, said frame bottom, and said frame top has a respective outwardly facing surface and at least one connector located on the respective outwardly facing surface; each of said at least one connector including a floor and a plurality of bristles extending outwardly from said floor;

wherein the building block toy is adapted to be couplable and decouplable from another complementary building block toy;

wherein a first at least one connector on a first surface of the building block toy is adapted to be couplable to and decouplable from a second at least one connector on a second surface of the other complementary building block toy, in that the first at least one connector may be coupled to the second at least one connector when the first surface are brought together, and when the first at least one connector and the second at least one connector are aligned while the first surface and the second surface are being brought together;

wherein the first at least one connector is on any of said frame sides, said frame bottom, and said frame top of the building block toy, and the second at least one connector is on any of other frame sides, other frame bottom, and other frame top of the other complementary building block toy; and wherein the frame defines an interior space bounded by the plurality of frame sides, the frame bottom, and the frame top, and wherein the interior space is adapted to contain the item.

2. The building block toy according to claim 1, the building block toy further comprising:

a container adapted to fit in the interior space, the container capable of storing the item, said container including a plurality of container sides, a container bottom coupled to the plurality of container sides, a container cavity located between the inwardly facing surfaces of the plurality of container sides and the container bottom, the cavity adapted to store the item, and a container top coupled to at least one of the plurality of container sides.

3. The building block toy according to claim 2, wherein said container top is a seal.

4. The building block toy according to claim 1, wherein said floor is recessed below the respective outwardly facing surface having the at least one connector.

5. The building block toy according to claim 1, wherein the frame further is adapted to contain the item, for which at least a portion of said item is a liquid, a semi-liquid, a solid food, or a combination thereof.

6. The building block toy according to claim 1, wherein said item is adapted to be prepackaged in said frame, and wherein said frame is adapted to package the item.

7. The building block toy according to claim 1, wherein said frame includes indicia, artwork, a label, or a combination thereof.

8. The building block toy according to claim 1, wherein said frame further comprises a frame tab on at least one frame side of the plurality of frame sides, the frame tab adapted to engage said frame top.

9. The building block toy according to claim 1, wherein each of said frame sides, said frame bottom, and said frame top has a respective recessed frame surface.

10. The building block toy according to claim 9, wherein each said recessed frame surface is a substantially centered, substantially square recessed frame surface.

11. The building block toy according to claim 1, wherein said frame top is coupled to at least one of said plurality of frame sides via a hinged section.

12. The building block toy according to claim 1, wherein each respective outwardly facing surface of each of said frame sides, said frame bottom, and said frame top includes four instances of said at least one connector, wherein each of the four instances is complementary to, but not necessarily identical to, another of the four instances.

13. The building block toy according to claim 12, wherein each respective outwardly facing surface of each of said frame sides, said frame bottom, and said frame top includes four unique corners, and wherein each unique corner includes one instance of said four instances of said at least one connector.

14. The building block toy according to claim 1, wherein the frame further is adapted to be removably couplable to said container, and wherein said container further is adapted to be removably couplable to said frame.

15. The building block toy according to claim 14, wherein said frame further is adapted to permit removal of the container through said frame top when said frame top is in an open position, and wherein said container further is adapted to removable from said frame through said frame top when said frame top is in the open position.

16. The building block toy according to claim 1, wherein at least a portion of said item is consumable.

17. The building block toy according to claim 1, wherein said frame sides, said frame top, and said frame bottom are solid.

18. The building block toy according to claim 1, wherein said first at least one connector of the building block toy is adapted to connect said second at least one connector of the other complementary building block toy regardless of orientation of the first at least one connector with respect to the second at least one connector.

19. The building block toy according to claim 1, wherein the building block toy is adapted to be couplable and decouplable from the other complementary building block toy regardless of orientation of the building block toy with respect to the other complementary building block toy.

* * * * *